US011062895B2

(12) United States Patent
Peterson et al.

(10) Patent No.: US 11,062,895 B2
(45) Date of Patent: Jul. 13, 2021

(54) MASS SPECTROMETER HAVING IMPROVED QUADRUPOLE ROBUSTNESS

(71) Applicant: Thermo Fisher Scientific (Bremen) GmbH, Bremen (DE)

(72) Inventors: Amelia Corinne Peterson, Bremen (DE); Jan-Peter Hauschild, Weyhe (DE); Oliver Lange, Bremen (DE); Alexander A. Makarov, Bremen (DE)

(73) Assignee: Thermo Fisher Scientific (Bremen) GmbH, Bremen (DE)

( * ) Notice: Subject to any disclaimer, the term of this patent is extended or adjusted under 35 U.S.C. 154(b) by 0 days.

(21) Appl. No.: 16/842,967

(22) Filed: Apr. 8, 2020

(65) Prior Publication Data

US 2020/0328073 A1 Oct. 15, 2020

(30) Foreign Application Priority Data

Apr. 15, 2019 (GB) ..... 1905286

(51) Int. Cl.
*H01J 49/42* (2006.01)
*H01J 49/02* (2006.01)
(Continued)

(52) U.S. Cl.
CPC ..... *H01J 49/4215* (2013.01); *H01J 49/0031* (2013.01); *H01J 49/022* (2013.01); *H01J 49/063* (2013.01); *H01J 49/421* (2013.01)

(58) Field of Classification Search
CPC .. H01J 49/4215; H01J 49/022; H01J 49/0031; H01J 49/063; H01J 49/421; G01N 27/62
(Continued)

(56) References Cited

U.S. PATENT DOCUMENTS 7,211,788 B2 5/2007 Marriott
2004/0108456 A1 6/2004 Sudakov et al.
(Continued)

FOREIGN PATENT DOCUMENTS

EP 3196640 A1 7/2017
JP 59123155 A 7/1984

OTHER PUBLICATIONS

Combined Search and Examination Report dated Oct. 11, 2019, to GB Patent Application No. 1905286.9.

*Primary Examiner* — Kiet T Nguyen

(57) ABSTRACT

A method of operating a mass spectrometer, comprising: generating ions from a sample; mass filtering the ions using a quadrupole mass filter having a set of selection parameters to transmit ions within at least one selected range of mass-to-charge ratios narrower than an initial range, wherein the quadrupole comprises four parallel elongate electrodes arranged in opposing pairs to which are applied RF and DC, wherein an attractive DC voltage is applied to one pair of opposing electrodes and a repulsive DC voltage is applied to the other pair; mass analysing or detecting the ions transmitted by the quadrupole mass filter; repeating the steps of generating ions, mass filtering and mass analysing or detecting multiple times; switching a configuration of the pairs of opposing electrodes to which the attractive DC voltage and the repulsive DC voltage are applied multiple times over the course of repeating the steps so that over long term operation the build-up of contamination on each pair of opposing electrodes is substantially equal; and determining mass filtering steps for which quantitative accuracy should be maintained between them and for the determined mass filtering steps maintaining the same configuration of the pairs of opposing electrodes to which the attractive DC voltage and the repulsive DC voltage are applied. The width of the selected mass range may change by not more than
(Continued)

10% when the ion transmission efficiency mass filter falls by 50% or more due to the build-up of contamination on the electrodes.

39 Claims, 5 Drawing Sheets

(51) Int. Cl.
*H01J 49/00* (2006.01)
*H01J 49/06* (2006.01)

(58) Field of Classification Search
USPC ..... 250/292, 290
See application file for complete search history.

(56) References Cited

U.S. PATENT DOCUMENTS

2005/0067564 A1 3/2005 Douglas et al.
2005/0258364 A1* 11/2005 Whitehouse ..... H01J 49/062
250/292

* cited by examiner

MASS SPECTROMETER HAVING IMPROVED QUADRUPOLE ROBUSTNESS

PRIORITY

This application claims priority to UK Patent Application 1905286.9, filed on Apr. 15, 2019, and titled "Mass Spectrometer Having Improved Quadrupole Robustness," by Peterson et al., which is hereby incorporated herein by reference in its entirety.

FIELD OF THE INVENTION

The invention relates to the field of mass spectrometry, to mass spectrometers, to methods of operating a mass spectrometer and to methods of mass spectrometry. The invention in particular relates to mass spectrometers that include a quadrupole mass filter.

BACKGROUND TO THE INVENTION

In many types of mass spectrometers ions are generated in an ion source, which is often at a relatively high pressure, such as atmospheric pressure, transmitted through ion optics, which typically focus and guide the ions, to a mass analyser located in a high vacuum chamber (e.g. $10^{-5}$ mbar or lower pressure). A quadrupole mass filter is often used to filter the ions in order to select ions of interest having a selected range of mass-to-charge ratios (m/z), for example for further manipulation, e.g. fragmentation, trapping and/or cooling, before mass analysis downstream.

A quadrupole mass filter comprises four parallel elongate electrodes, such as rods, spaced apart in a square arrangement. Opposing electrodes are connected together electrically and a voltage is applied between one pair of rods and the other, which comprises a radio frequency (RF) voltage with a DC offset voltage. Ions travel through the quadrupole between the electrodes. For given values of RF and DC voltages, ions of a certain mass-to-charge ratio (m/z) will be transmitted through the quadrupole while other ions will have unstable trajectories and collide with the electrodes. An attractive DC voltage (e.g. negative) is applied to one pair of opposing rods and an equal magnitude repulsive DC voltage (e.g. positive) is applied to the other pair of opposing rods. The attractive and repulsive DC voltages impose a mass cut-off to the range of ion m/z ratios that can pass through the quadrupole filter. Typically, ions with m/z ratios higher than the selected m/z ratio collide with the attractive rods, while ions with lower m/z ratios collide with the repulsive rods. With an appropriate calibration of the RF and DC voltages, the quadrupole mass filter can filter ions over a wide-range of m/z ratios and with variable mass selection window widths.

Typically, due to quadrupole manufacturing techniques, mechanical tolerances and/or electronics limitations, the attractive and repulsive DC voltages during instrument operation are always applied to the same opposing rod pairs. This means that as ions are filtered by the device, ions with unstable trajectories having a mass-to-charge ratio greater than the isolated m/z will preferentially deposit on the pair of opposing rods with attractive DC, and ions with lower mass-to-charge ratios on the pair with repulsive DC. Over time, especially under high ion load and challenging sample conditions, the deposition of material and subsequent charging of this material will lead to disturbances in the quadrupolar field and thus the performance of the mass filter will suffer, for example in the form of transmission loss and calibration obsolescence due to drift of the instrument. This is greatly facilitated by the large difference in energies lower and higher mass-to-charge ratios have as they impinge on the respective electrodes; the energy difference results in the formation of films with different structures and conductivities on attractive and repulsive rods. The quadrupole mass filter then requires mechanical cleaning to regain the lost performance.

In order to extend the length of time between cleanings, an additional quadrupole mass filter having reduced analytical performance can be employed upstream of the analytical quadrupole mass filter. This so-called mass pre-filter can be used to decrease the abundance of non-desired ions that must be filtered out by the analytical mass filter. The mass pre-filter filter performs a coarse isolation of ions in a wide window around the m/z ratio to be isolated by the analytical mass filter (U.S. Pat. No. 7,211,788). Additionally, it is possible to increase the energy of the ions as they pass through the mass filter in order to spread the deposition of material over a larger surface area and delay the onset of performance-altering quadrupolar field disturbances. This approach, however, has performance drawbacks as the increased ion energy leads to so-called ion noding and poor isolation profiles in the quadrupole, as well as reduced transmission, which decreases the quantitative accuracy of the device.

Against this background the present invention has been made.

SUMMARY OF THE INVENTION

According to an aspect of the invention there is provided a method according to claim 1.

A method of operating a mass spectrometer comprises generating ions from a sample having an initial range of mass-to-charge ratios and mass filtering the generated ions using a quadrupole mass filter. The quadrupole mass filter is operated with a set of selection parameters for transmitting ions through the quadrupole mass filter within at least one selected range of mass-to-charge ratios that is narrower than the initial range, while ions outside the selected range are not transmitted. For example, at least a portion of the non-transmitted ions collide with elongate electrodes of the quadrupole mass filter. The quadrupole mass filter comprises four parallel elongate electrodes arranged in opposing pairs to which are applied RF and DC voltages during mass filtering, wherein an attractive DC voltage that is attractive to the ions is applied to one pair of opposing electrodes and a repulsive DC voltage that is repulsive to the ions is applied to the other pair of opposing electrodes. As known in the art, an RF voltage is applied to one pair of opposing electrodes, while an equal and opposite phase RF voltage is applied to the other pair of opposing electrodes. In some embodiments, the method further comprises mass analysing or detecting the ions transmitted by the quadrupole mass filter. The steps of generating ions, mass filtering and mass analysing or detecting are repeated multiple times. In embodiments, over the course of repeating the aforementioned steps of generating ions, mass filtering and mass analysing or detecting, a configuration of the pairs of opposing electrodes to which the attractive DC voltage and the repulsive DC voltage are applied is switched multiple times so that over long term operation each pair of opposing electrodes spends substantially half the time with the attractive DC voltage applied to it and half the time with the repulsive DC voltage applied to it. In embodiments, over the course of repeating the aforementioned steps of generating ions, mass filtering and mass analysing or detecting, a configuration of the pairs of opposing electrodes to which the attractive DC voltage and the repulsive DC voltage are applied is switched multiple times so that over long term operation the build-up of contamination on each pair of opposing electrodes is substantially equal. The method preferably further comprises determining mass filtering steps between which quantitative accuracy should be maintained and for the determined mass filtering steps maintaining the same configuration of the pairs of opposing electrodes to which the attractive DC voltage and the repulsive DC voltage are applied.

According to another aspect of the invention there is provided a method of operating a mass spectrometer, comprising:

generating ions from a sample having an initial range of mass-to-charge ratios;

mass filtering the ions using a quadrupole mass filter having a set of selection parameters to transmit ions through the quadrupole mass filter within at least one selected range of mass-to-charge ratios that is narrower than the initial range, while ions outside the selected range are not transmitted, wherein the quadrupole mass filter comprises four parallel elongate electrodes arranged in opposing pairs to which are applied RF and DC voltages, wherein an attractive DC voltage that is attractive to the ions is applied to one pair of opposing electrodes and a repulsive DC voltage that is repulsive to the ions is applied to the other pair of opposing electrodes, wherein a portion of the ions outside the selected range that are not transmitted collide with the electrodes and cause a build-up of contamination on the electrodes;

repeating the steps of generating ions and mass filtering multiple times; and switching multiple times a configuration of the pairs of opposing electrodes to which the attractive DC voltage and the repulsive DC voltage are applied over the course of repeating the steps, such that over long term operation each pair of opposing electrodes spends substantially half the time with the attractive DC voltage applied to it and half the time with the repulsive DC voltage applied to it (and/or such that over long term operation the build-up of contamination on each pair of opposing electrodes is substantially equal);

wherein for a narrowest selected range of ions transmitted through the quadrupole mass filter, the width of the isolated range at half-maximum ion transmission changes by not more than 10% when the ion transmission efficiency falls by 50% or more due to the build-up of contamination on the electrodes.

Since over long term operation of the mass spectrometer each pair of opposing electrodes spends substantially half the time with the attractive DC voltage applied to it and half the time with the repulsive DC voltage applied to it, the build-up of contamination on the quadrupole mass filter can be made to occur substantially equally, i.e. symmetrically, on each of the four electrodes, i.e. the amount of contamination is substantially equal on each of the electrodes. For example, any difference of deposited contamination between the electrodes may be within 10% or 5% of the total contamination on any one of the electrodes, such as measured by densitometry. Diagnostically, such differences in deposited contamination can be measured by the similarity of the mass isolation peak shapes when each configuration of the pairs of opposing electrodes is used for a calibration mixture of ions. The differences in deposited contamination can be confirmed by densitometry measurements under a microscope (after removing the quadrupole) since the deposited contamination is visible, e.g. up to micron(s) thick. Another approach to measure contamination can be to set the spectrometer such that positive ions deposit only on one pair of opposing electrodes and negative ions deposit only on the other pair, intermittently measure (e.g. with positive ions) the transmission of the quadrupole for both configurations of the pairs of opposing electrodes, and continue these steps of deposition and transmission measurement alternately over time. If the transmission ratio between the two configurations of electrodes stays constant over time, e.g. stays between 0.75 and 1.25, the quadrupole can be considered to be acceptably clean. If the ratio over time falls outside that range, the quadrupole can be deemed unacceptably dirty (with very dirty quadrupoles the ratio can reach up to 7.0). It is further possible to diagnostically measure how much the transmission curves for each configuration of opposing electrodes have diverged from each other relative to the "clean" state, without use of negative ions. For example, the isolation transmission (relative to RF-only operation) versus the quadrupole resolution may differ between each configuration of the opposing electrode pairs by a small amount, e.g. 5%, when "clean". With a symmetrical and equal contamination process, the isolation transmission difference is not expected to change significantly, while a non-symmetric process would lead to significant changes. Due to such symmetrical build-up of contamination on the electrodes of the mass filter, for the narrowest selected range (narrowest isolation width) of ions transmitted through the quadrupole mass filter, the width of the isolated range at half-maximum ion transmission changes by not more than 10% when the ion transmission efficiency falls by 50% or more due to the build-up of contamination on the electrodes. This slows down the time it takes for the performance of the quadrupole mass filter to be significantly affected, e.g., in terms of its mass calibration and/or ion transmission efficiency, and/or before cleaning of the electrodes of the mass filter becomes necessary. This is especially advantageous for an analytical quadrupole mass filter, for example a quadrupole mass filter that provides the final mass filtering before the ions reach an ion detector or mass analyser, or a quadrupole mass filter capable of mass filtering a narrow selected range having a width of 10 Th or less or 5 Th or less.

Thus, further embodiments of the invention can be provided comprising a method of operating a mass spectrometer by:

generating ions from a sample having an initial range of mass-to-charge ratios;

mass filtering the ions using a quadrupole mass filter having a set of selection parameters to transmit ions through the quadrupole mass filter within at least one selected range of mass-to-charge ratios that is narrower than the initial range, while ions outside the selected range are not transmitted, wherein the quadrupole mass filter comprises four parallel elongate electrodes arranged in opposing pairs to which are applied RF and DC voltages, wherein an attractive DC voltage that is attractive to the ions is applied to one pair of opposing electrodes and a repulsive DC voltage that is repulsive to the ions is applied to the other pair of opposing electrodes, wherein a portion of the ions outside the selected range that are not transmitted collide with the electrodes and cause a build-up of contamination on the electrodes;

repeating the steps of generating ions and mass filtering multiple times;

switching multiple times a configuration of the pairs of opposing electrodes to which the attractive DC voltage and the repulsive DC voltage are applied over the course of repeating the steps of generating ions and mass filtering, such that over long term operation each pair of opposing electrodes spends substantially half the time with the attractive DC voltage applied to it and half the time with the repulsive DC voltage applied to it; and operating the mass spectrometer (between cleanings) by repeating the steps of generating ions and mass filtering multiple times until the ion transmission efficiency of the quadrupole mass filter falls by 50% or more due to the build-up of contamination on the electrodes but for a narrowest selected range of ions transmitted through the quadrupole mass filter the width of the range at half-maximum ion transmission changes by not more than 10%. The method may further comprise cleaning the electrodes of the quadrupole mass filter when the ion transmission efficiency of the quadrupole mass filter falls by 50% or more due to the build-up of contamination on the electrodes but for a narrowest selected range of ions transmitted through the quadrupole mass filter the width of the range at half-maximum ion transmission changes by not more than 10%. Thus, the operation of the mass spectrometer may be performed until the next cleaning step is required. The method in some embodiments may comprise operating the mass spectrometer until by repeating the steps of generating ions and mass filtering multiple times until the ion transmission efficiency of the quadrupole mass filter falls by falls by 50-90%, 50-80%, 50-70%, or 50-60% but for a narrowest selected range of ions transmitted through the quadrupole mass filter the width of the range at half-maximum ion transmission changes by not more than 10%. The fall of 50% or more in ion transmission and the change by not more than 10% in the width of the selected range are changes compared to the ion transmission and width of the range of the quadrupole mass filter when the electrodes are clean, i.e. have been freshly cleaned (immediately after the electrodes have been cleaned in a previous cleaning operation).

According to still another aspect of the invention, there is provided a method of operating a mass spectrometer, comprising:

generating ions from a sample having an initial range of mass-to-charge ratios;

mass filtering the ions using a quadrupole mass filter having a set of selection parameters to transmit ions through the quadrupole mass filter within at least one selected range of mass-to-charge ratios that is narrower than the initial range, while ions outside the selected range are not transmitted, wherein the quadrupole mass filter comprises four parallel elongate electrodes arranged in opposing pairs to which are applied RF and DC voltages, wherein an attractive DC voltage that is attractive to the ions is applied to one pair of opposing electrodes and a repulsive DC voltage that is repulsive to the ions is applied to the other pair of opposing electrodes, wherein a portion of the ions outside the selected range that are not transmitted collide with the electrodes and cause a build-up of contamination on the electrodes;

repeating the steps of generating ions and mass filtering multiple times; and switching multiple times a configuration of the pairs of opposing electrodes to which the attractive DC voltage and the repulsive DC voltage are applied over the course of repeating the steps, such that over long term operation each pair of opposing electrodes spends substantially half the time with the attractive DC voltage applied to it and half the time with the repulsive DC voltage applied to it, wherein the method further comprises increasing the energy of the ions as they enter the quadrupole mass filter when the ion transmission of the quadrupole mass filter falls due to the build-up of contamination on the electrodes. Thus, in some embodiments, over the course of repeating the steps of generating ions and mass filtering the ions multiple times, e.g. over long term operation, the energy of the ions as they enter the quadrupole mass filter is increased. The increase in ion energy is to compensate the build-up of contamination on the electrodes, which acts to decrease the ion transmission of the quadrupole mass filter. The increase in ion energy preferably acts to maintain the ion transmission of the mass filter as high as possible. After the energy is increased, a mass recalibration of the quadrupole mass filter may optionally be performed. By increasing the ion energy over time, the length of time between cleaning operations to remove the contamination on the electrodes can be extended.

According to even another aspect of the invention, there is provided a method of operating a mass spectrometer, comprising:

generating ions from a sample having an initial range of mass-to-charge ratios;

mass filtering the ions using a quadrupole mass filter having a set of selection parameters to transmit ions through the quadrupole mass filter within at least one selected range of mass-to-charge ratios that is narrower than the initial range, while ions outside the selected range are not transmitted, wherein the quadrupole mass filter comprises four parallel elongate electrodes arranged in opposing pairs to which are applied RF and DC voltages, wherein an attractive DC voltage that is attractive to the ions is applied to one pair of opposing electrodes and a repulsive DC voltage that is repulsive to the ions is applied to the other pair of opposing electrodes, wherein a portion of the ions outside the selected range that are not transmitted collide with the electrodes and cause a build-up of contamination on the electrodes;

repeating the steps of generating ions and mass filtering multiple times; and switching multiple times a configuration of the pairs of opposing electrodes to which the attractive DC voltage and the repulsive DC voltage are applied over the course of repeating the steps, such that over long term operation each pair of opposing electrodes spends substantially half the time with the attractive DC voltage applied to it and half the time with the repulsive DC voltage applied to it, wherein the different configurations of the pairs of opposing electrodes have a difference in ion transmission of the quadrupole mass filter and the method comprises adjusting one or more parameters of the mass spectrometer in order to compensate for the difference in ion transmission in a mass analysis. In some embodiments, the compensation comprises de-tuning one or more ion optical devices between the ion source and the mass analyser or detector, or adjusting the injection time for introducing ions into the mass analyser for mass analysis, or to the detector, or into another ion optical device (such as an ion trap) upstream of the mass analyser or detector. For example, the voltage applied to one or more ion lenses along the beam path could be changed to reduce the ion current for the rod configuration with the higher ion transmission. In another embodiment, the mass isolation window could be made slightly wider for the rod configuration with the lower ion transmission and therefore raise transmission in this "analogue" way, effectively employing a slightly different mass calibration for each configuration of opposing electrode pairs. In this way, the effect on the mass analysis of the ion transmission difference of the different configurations of the mass filter can be effectively reduced or eliminated. Alternatively, the isolation width could be kept the same for each configuration of opposing electrode pairs and, for the configuration having the higher transmission, the centre of the isolation window could be shifted slightly away from a target ion to be transmitted, such that the target ion lies at the sloped side of the isolation window (not at the peak) and thereby is transmitted less in order to match its transmission with the configuration having the lower transmission. Thus, different mass calibrations could be applied to the different configurations of the pairs of opposing electrodes, such as applying an offset to a mass calibration for one configuration when the other configuration is used.

According to a further aspect of the invention there is provided a mass spectrometer according to claim 22.

A mass spectrometer comprises: an ion source for generating ions from a sample having an initial range of mass-to-charge ratios and a quadrupole mass filter operated with a set of selection parameters for mass filtering the generated ions so as to transmit ions through the quadrupole mass filter within at least one selected range of mass-to-charge ratios that is narrower than the initial range, while ions outside the selected range are not transmitted. The quadrupole mass filter comprises four parallel elongate electrodes arranged in opposing pairs to which are applied RF and DC voltages, wherein an attractive DC voltage that is attractive to the ions is applied to one pair of opposing electrodes and a repulsive DC voltage that is repulsive to the ions is applied to the other pair of opposing electrodes. A mass analyser or detector is provided to receive ions transmitted through the quadrupole mass filter. A controller is provided that is configured to control the quadrupole mass filter and switch a configuration of the pairs of opposing electrodes to which the attractive DC voltage and the repulsive DC voltage are applied multiple times over the course of repeating steps of generating ions and mass filtering the ions so that over long term operation of the mass spectrometer each pair of opposing electrodes spends substantially half the time with the attractive DC voltage applied to it and half the time with the repulsive DC voltage applied to it (and/or over long term operation the build-up of contamination on each pair of opposing electrodes is substantially equal), the controller being further configured to determine mass filtering steps between which quantitative accuracy should be maintained and for the determined mass filtering steps maintain the same configuration of the pairs of opposing electrodes to which the attractive DC voltage and the repulsive DC voltage are applied.

According to a still further aspect of the invention there is provided a mass spectrometer, comprising:

an ion source for generating ions from a sample having an initial range of mass-to-charge ratios;

a quadrupole mass filter having a set of selection parameters for mass filtering the ions so as to transmit ions through the quadrupole mass filter within at least one selected range of mass-to-charge ratios that is narrower than the initial range, while ions outside the selected range are not transmitted, wherein the quadrupole mass filter comprises four parallel elongate electrodes arranged in opposing pairs to which are applied RF and DC voltages, wherein an attractive DC voltage that is attractive to the ions is applied to one pair of opposing electrodes and a repulsive DC voltage that is repulsive to the ions is applied to the other pair of opposing electrodes, wherein a portion of the ions outside the selected range that are not transmitted collide with the electrodes and cause a build-up of contamination on the electrodes;

a mass analyser or detector to analyse or detect ions transmitted through the quadrupole mass filter; and a controller configured to control the quadrupole mass filter and switch a configuration of the pairs of opposing electrodes to which the attractive DC voltage and the repulsive DC voltage are applied multiple times over the course of repeating steps of generating ions and mass filtering the ions so that over long term operation of the mass spectrometer each pair of opposing electrodes spends substantially half the time with the attractive DC voltage applied to it and half the time with the repulsive DC voltage applied to it, and/or the build-up of contamination on each pair of opposing electrodes is substantially equal, whereby for a narrowest selected range of ions transmitted through the quadrupole mass filter, the width of the range at half-maximum ion transmission changes by not more than 10% when an ion transmission efficiency of the quadrupole mass filter falls by 50% or more due to the build-up of contamination on the electrodes.

According to a yet further aspect of the invention there is provided a mass spectrometer, comprising:

an ion source for generating ions from a sample having an initial range of mass-to-charge ratios;

a quadrupole mass filter having a set of selection parameters for mass filtering the ions so as to transmit ions through the quadrupole mass filter within at least one selected range of mass-to-charge ratios that is narrower than the initial range, while ions outside the selected range are not transmitted, wherein the quadrupole mass filter comprises four parallel elongate electrodes arranged in opposing pairs to which are applied RF and DC voltages, wherein an attractive DC voltage that is attractive to the ions is applied to one pair of opposing electrodes and a repulsive DC voltage that is repulsive to the ions is applied to the other pair of opposing electrodes, wherein a portion of the ions outside the selected range that are not transmitted collide with the electrodes and cause a build-up of contamination on the electrodes;

a mass analyser or detector to analyse or detect ions transmitted through the quadrupole mass filter; and a controller configured to control the quadrupole mass filter and switch a configuration of the pairs of opposing electrodes to which the attractive DC voltage and the repulsive DC voltage are applied multiple times over the course of repeating steps of generating ions and mass filtering the ions so that over long term operation of the mass spectrometer each pair of opposing electrodes spends substantially half the time with the attractive DC voltage applied to it and half the time with the repulsive DC voltage applied to it. In some preferred embodiments, the controller is further configured to increase the energy of the ions as they enter the quadrupole mass filter when the ion transmission of the quadrupole mass filter falls due to a build-up of contamination on the electrodes.

According to an even further aspect of the invention there is provided a mass spectrometer, comprising:

an ion source for generating ions from a sample having an initial range of mass-to-charge ratios;

a quadrupole mass filter having a set of selection parameters for mass filtering the ions so as to transmit ions through the quadrupole mass filter within at least one selected range of mass-to-charge ratios that is narrower than the initial range, while ions outside the selected range are not transmitted, wherein the quadrupole mass filter comprises four parallel elongate electrodes arranged in opposing pairs to which are applied RF and DC voltages, wherein an attractive DC voltage that is attractive to the ions is applied to one pair of opposing electrodes and a repulsive DC voltage that is repulsive to the ions is applied to the other pair of opposing electrodes, wherein a portion of the ions outside the selected range that are not transmitted collide with the electrodes and cause a build-up of contamination on the electrodes;

a mass analyser or detector to analyse or detect ions transmitted through the quadrupole mass filter; and a controller configured to control the quadrupole mass filter and switch a configuration of the pairs of opposing electrodes to which the attractive DC voltage and the repulsive DC voltage are applied multiple times over the course of repeating steps of generating ions and mass filtering the ions so that over long term operation of the mass spectrometer each pair of opposing electrodes spends substantially half the time with the attractive DC voltage applied to it and half the time with the repulsive DC voltage applied to it wherein the different configurations of the pairs of opposing electrodes have a difference in ion transmission of the quadrupole mass filter and the controller is further configured to adjust one or more parameters of the mass spectrometer in order to compensate for the difference in ion transmission.

In some embodiments, the configuration is preferably switched based on the selection parameters of the quadrupole mass filter and/or a use-based trigger. Thus, the controller is preferably configured to switch the configuration based on the selection parameters of the quadrupole mass filter and/or a use-based trigger.

In some embodiments, preferably the one or more selected range of mass-to-charge ratios has a width 10 Th or less.

In some embodiments, preferably the steps of generating ions and mass filtering the ions are repeated multiple times using different sets of selection parameters of the quadrupole mass filter.

In some embodiments, the configuration of the pair of opposing electrodes to which the attractive DC voltage is applied and the pair of opposing electrodes to which the repulsive DC voltage is applied preferably are the same each time ions are selected using substantially the same selection parameters of the quadrupole mass filter and/or when samples used to generate the ions are related by similarities in their time of analysis or composition. Thus, preferably the controller is configured such that the pair of opposing electrodes to which the attractive DC voltage is applied and the pair of opposing electrodes to which the repulsive DC voltage is applied are the same each time ions are selected using substantially the same selection parameters of the quadrupole mass filter and/or when the samples used to generate the ions are related.

In some embodiments, the method preferably further comprises calculating a unique code for each set of selection parameters and, based on at least one rule, using the unique code to determine the pair of opposing electrodes to which the attractive DC voltage is applied and the pair of opposing electrodes to which the repulsive DC voltage is applied. The controller thus can be configured to set selection parameters of the quadrupole mass filter to transmit the at least one selected range of mass-to-charge ratios and to calculate a unique code for each set of selection parameters and, based on at least one rule, use the unique code to determine the pair of opposing electrodes to which the attractive DC voltage is applied and the pair of opposing electrodes to which the repulsive DC voltage is applied. The code can be generated using a code generating algorithm. In some embodiments, preferably the unique code is a code calculated using a hash function (hashing algorithm). The unique code is thus preferably a hash code. In some embodiments, the unique code is calculated based on a centre mass and/or based on a first mass and a last mass of the selected range of mass-to-charge ratios. In some embodiments, the unique code is calculated based on a rounded down centre mass and/or based on a rounded down first mass and a rounded up last mass of the selected range of mass-to-charge ratios. In embodiments wherein the unique code is calculated based on a centre mass of the selected range of mass-to-charge ratios, the electrode configuration for a specific centre mass is independent of the selected range width used during the filtering.

In some embodiments, the at least one rule comprises applying the attractive DC voltage to a first pair of opposing electrodes and the repulsive DC voltage to a second pair of opposing electrodes if the unique code is an even value and applying the attractive DC voltage to the second pair of opposing electrodes and the repulsive DC voltage to the first pair of opposing electrodes if the unique code is an odd value. In some embodiments, the unique code is multiplied or divided by a factor to increase or decrease the frequency in the mass-to-charge ratio domain of switching the pairs of opposing electrodes to which the attractive DC and repulsive voltages are applied. Preferably, the factor is such that the selected range of mass-to-charge ratios is sufficiently narrower than the average interval in the mass-to-charge ratio domain between switching the pairs of opposing electrodes such that transmitted ions in a range of mass-to-charge ratios $x-0.5w$ to $x+0.5w$, where x is the centre mass and w is the width of the selected range, will most likely be selected using the same pairs of opposing electrodes to which the attractive DC and repulsive voltages are applied if they are selected in a subsequent overlapping mass filtering step.

In some embodiments, the pair of opposing electrodes to which the attractive DC voltage is applied and the pair of opposing electrodes to which the repulsive DC voltage is applied are switched based on one or more use-based, i.e. use-dependent, triggers. The one or more use-dependent triggers may comprise one or more time-dependent or event-dependent triggers. The one or more time-dependent or event-dependent triggers may comprise running a mass calibration procedure or elapse of a predetermined time period since the pair of opposing electrodes were last switched.

In some embodiments, the method further comprises measuring (i.e. collecting) and storing usage data representing the usage (i.e. relative deposition of higher mass-to-charge ratio ions) of each pair of opposing electrodes when each of the attractive DC voltage and the repulsive DC voltage is applied and, based on the usage data, switching the pair of opposing electrodes to which the attractive DC voltage is applied and the pair of opposing electrodes to which the repulsive DC voltage is applied such that on average each pair of opposing electrodes spends substantially half the time with the attractive DC voltage applied to it and half the time with the repulsive DC voltage applied to it. Thus, the controller can be configured to collect and store usage data representing the usage of each pair of opposing electrodes when each of the attractive DC voltage and the repulsive DC voltage is applied and, based on the usage data, switch the pair of opposing electrodes to which the attractive DC voltage is applied and the pair of opposing electrodes to which the repulsive DC voltage is applied such that on average each pair of opposing electrodes spends substantially half the time with the attractive DC voltage applied to it and half the time with the repulsive DC voltage applied to it. For example, the controller may store real time data on the usage of each pair of opposing electrodes. This usage data can comprise, in a simple case, a measured total number of ion introduction events for each configuration (e.g. x number of ion injections through the quadrupole mass filter for one configuration, y number of ion injections for the other configuration), a measured time (e.g. the total injection time for all ion injections through the quadrupole mass filter for one configuration and the total injection time for all ion injections through the mass filter for the other configuration), or a measured charge (e.g. representing the charge flowing through the quadrupole mass filter for each configuration, which can be based on an ion current measured at the mass analyser or ion detector for each injection event (thereby providing a total accumulated charge for each of the two configurations)). In some embodiments, the charge "lost" to the quadrupole mass filter (i.e. the non-transmitted charge) can be measured through a comparison of the ion current when substantially all ions are transmitted through the quadrupole (e.g. in a prior 'full mass range' or MS1 scan) and the ion current transmitted when mass filtering is performed. In a further refinement, a m/z distribution dependent scaling of the charge lost to the quadrupole could be made, by weighting the charge lost to the quadrupole by high m/z ions higher than charge lost to the quadrupole by ions having low m/z.

In further preferred embodiments, the invention comprises tracking or measuring the usage of the electrodes of the quadrupole to ensure that over the long term the pairs of electrodes are used half the time in one configuration and half the time in the other configuration and the contamination builds up evenly (symmetrically) on the electrodes). In such an embodiment, it is possible to acquire usage data as data representing the amount of contamination on each pair of opposing electrodes and, based on the data, switching the pair of opposing electrodes to which the attractive DC voltage is applied and the pair of opposing electrodes to which the repulsive DC voltage is applied so as to balance the amount of contamination equally between each pair of opposing electrodes. Thus, the controller can be configured to switch the pair of opposing electrodes to which the attractive DC voltage is applied and the pair of opposing electrodes to which the repulsive DC voltage is applied based on data representing an amount of contamination on each pair of opposing electrodes. In some embodiments, the mass spectrometer can measure, e.g. as part of routine calibrations or evaluations, the rate of charge-up on each pair of opposing electrodes individually as a shift in the main electrode DC stopping curve per unit charge impinged as described above. This rate of charge up correlates with the relative contamination levels of the two pairs of electrodes. The spectrometer controller can compare the two rates (for each electrode pair) and feed this information into an active balancing mechanism. The active balancing mechanism can detect an imbalance in the relative usage of the electrode pairs in each configuration by means of the aforementioned usage data (e.g. monitoring the aforementioned data and/or contamination measurements) and actively adjust the electrode switching algorithm to bring the electrode usage to an equal state (i.e. switching the pair of opposing electrodes to which the attractive DC voltage is applied and the pair of opposing electrodes to which the repulsive DC voltage is applied such that on average each pair of opposing electrodes spends substantially half the time with the attractive DC voltage applied to it and half the time with the repulsive DC voltage applied to it, and/or so as to balance the amount of contamination equally between each pair of opposing electrodes). In some embodiments, this can be accomplished (depending on the mode of switching) by modifying the code-generating (hashing) algorithm, or (if in a time-based switching mode) by using different times for each configuration of electrode pairs (e.g. instead of 5 seconds (s) in one configuration and 5 s in the other configuration, using 5 s in one configuration and 4 s in the other configuration), or (if in an event triggered mode) skipping one or more electrode pair switch events.

In some embodiments, the method comprises pre-filtering the ions before mass filtering the ions using the quadrupole mass filter, wherein pre-filtering the ions comprises transmitting to the quadrupole mass filter ions within a pre-selected range of mass-to-charge ratios that includes but is wider than the selected range of mass-to-charge ratios selected by the quadrupole mass filter. Accordingly, the mass spectrometer may comprise one or more mass pre-filters, located upstream of the quadrupole mass filter, for filtering the ions before the quadrupole mass filter, wherein the one or more mass pre-filters are controlled to transmit to the quadrupole mass filter ions within a pre-selected range of mass-to-charge ratios that includes but is wider than the selected range of mass-to-charge ratios selected by the quadrupole mass filter. Preferably, the pre-selected range has a width greater than 10 Th, or greater than 50 Th, or greater than 100 Th.

In some embodiments, the method comprises increasing the energy of the ions as they enter the quadrupole mass filter when the ion transmission of the quadrupole mass filter falls due to the build-up of contamination on the electrodes. Thus, the controller can be further configured to increase the energy of the ions as they enter the quadrupole mass filter when the ion transmission of the quadrupole mass filter falls due to a build-up of contamination on the electrodes Whereas embodiments of the invention provide that over long term operation of the mass spectrometer each pair of opposing electrodes spends substantially half the time with the attractive DC voltage applied to it and half the time with the repulsive DC voltage applied to it, in some embodiments, over a short term, a pair of opposing electrodes can spend more than half the time with the attractive DC voltage applied to it and less than half the time with the repulsive DC voltage applied to it or vice versa (i.e. more than half the time with the repulsive DC voltage applied to it and less than half the time with the attractive DC voltage applied to it) in order to optimize a quantitative accuracy of the mass analysing step. Thus, the configuration of the pairs of opposing electrodes to which the attractive DC voltage and the repulsive DC voltage are applied is not simply switched between every consecutive step of mass filtering when a quantitative analysis or comparison of the transmitted ions is required.

It is a preferred feature that any effects of transmission differences of the quadrupole mass filter between the configurations of the pairs of opposing electrodes are effectively removed for quantitative analysis. The configuration of the pairs of opposing electrodes can be set the same for steps of mass filtering in which the transmitted ions are quantitatively analysed. The configuration can thus be kept constant for steps of mass filtering in which the transmitted ions are quantitatively analysed, especially quantitatively analysed with respect to each other.

In some embodiments, if switching the polarities of the quadrupole electrodes does not change the shape or transmission of the mass selection window or range significantly, even at the narrowest selection width employed, then the quantitative accuracy of the quadrupole mass filter similarly does not suffer significantly from the switching and therefore the measures described above may not be needed. For example, it may not be necessary in such cases to employ determining between which mass filtering steps quantitative accuracy should be maintained and for the determined mass filtering steps maintaining the same configuration of the pairs of opposing electrodes to which the attractive DC voltage and the repulsive DC voltage are applied. Nevertheless, the switching of the pairs of opposing electrodes, which for example could comprise simply alternating the configuration of the pairs on every mass filtering step or after every fixed number of mass filtering steps, still yields the symmetrical distribution of the contamination build-up and therefore the extension of the time required between cleaning operations for the mass filter. Any small differences in such cases could be compensated as described above.

The quadrupole mass filter is typically constructed using metal electrodes, such as rods, of a certain cross-sectional shape arranged parallel to each other and symmetrically around a central axis. The transverse cross sectional shape of the rods can be of various shapes, depending on the desired use. The electrode shapes are typically rectangular, round or hyperbolic. The quadrupole mass filter is preferably an analytical quadrupole mass filter, that is capable of, and typically used for, filtering a relatively narrow selected mass range, e.g. having a width that is 100 Th or less, 50 Th or less, 20 Th or less, 10 Th or less, 5 Th or less, 2 Th or less, or 1 Th or less. The selected range of mass-to-charge ratios preferably has a width 10 Th or less. The width is typically at least 0.5 Th wide. The selected mass range may have a width in the range of 0.5 to 10 Th for example, such as in the range of 0.5 to 5 Th, or 0.5 to 2 Th, or 0.5 to 1.5 Th, or in the range of 0.7 to 1.4 Th. The quadrupole mass filter may be located downstream of one or more mass pre-filters, such as quadrupole mass pre-filters or ion mobility filters. The one or more mass pre-filters typically are not capable of filtering a mass range as narrow as the analytical quadrupole mass filter at equally high transmission. The one or more mass pre-filters can be used to decrease the abundance of non-desired ions that must be filtered out by the analytical mass filter and therefore reduce the amount of ions that are deposited onto the electrodes of the analytical mass filter during a given period of mass filtering. The mass pre-filter filter thus performs a coarse isolation of ions in a wider window around the m/z ratio to be isolated by the analytical mass filter. Thus, the invention preferably comprises pre-filtering the ions before mass filtering the ions using the quadrupole mass filter, wherein pre-filtering the ions comprises transmitting to the quadrupole mass filter ions within a pre-selected range of mass-to-charge ratios that includes but is wider than the selected range of mass-to-charge ratios selected by the quadrupole mass filter. The pre-selected range may have a width greater than 10 Th, or greater than 50 Th, or greater than 100 Th, or greater than 200 Th (e.g. 300 Th).

After generating and mass filtering the ions, there is typically a step of mass analysing the ions transmitted by the quadruple mass filter in the selected range of mass-to-charge ratios. Mass analysing ions typically comprises detecting ions to produce mass spectral data. In some embodiments, after mass filtering, there are one or more optional steps of processing the ions before mass analysing or detecting the ions. The processing may comprise one or more of fragmenting, trapping and cooling the ions. The processing may take place in one or more ion optical devices. The one or more ion optical devices may comprise one or more of a fragmentation cell, ion trap and ion guide. The ions may be mass analysed using a mass analyser located downstream of the quadrupole mass filter and optionally downstream of the one or more ion optical devices. The mass analyser may comprise an ion detector. The mass analyser may be able to separate the ions based on their mass-to-charge ratio and may comprise one or more of the following types of mass analyser: an ion trap, e.g. RF ion trap, electrostatic ion trap, electrostatic orbital trap (such as an Orbitrap™ mass analyser), Fourier transform (FTMS) mass analyser, Fourier transform ion cyclotron resonance (FT-ICR) mass analyser, time of flight (TOF) mass analyser, e.g. linear TOF mass analyser, orthogonal acceleration TOF (OA-TOF) mass analyser, reflectron TOF, multi-reflection TOF (MR-TOF) mass analyser, quadrupole mass analyser, or magnetic sector mass analyser. The mass analyser is preferably capable of higher mass resolution than the quadrupole mass filter. Preferably, the mass analyser is capable of high resolution and/or accurate mass (HR-AM). For example, a mass analyser that is capable of resolving power >25,000 or >50,000 or >100,000 or >200,000 at mass 400 and/or mass accuracy <10 ppm, or <5 ppm, or <3 ppm, or <2 ppm. Such mass analysers can include one of: a time-of-flight type; an orbital trapping type; and a Fourier Transform Ion Cyclotron Resonance, FT-ICR, type. Preferably, the mass spectrometer comprises a mass analyser that is capable of measuring all of the m/z of interest in one acquisition or scan. Preferred mass spectrometers comprise an electrostatic ion trap, electrostatic orbital trap, or an FT-ICR, or a TOF such as a single-reflection or multi-reflection (MR)-TOF (preferably MR-TOF). Ion detectors for such mass analysers may be used to detect the ions separated by the mass analyser. Image current detectors, electron multipliers, microchannel plates, scintillators and/or photomultipliers may be used to detect ions. Preferably, the mass analysis provides a quantitative analysis of the ions.

The invention provides that, over the long term operation of the mass spectrometer, each pair of opposing electrodes spends (e.g. on average) substantially half the time with the attractive DC voltage applied to it and half the time with the repulsive DC voltage applied to it. Thus, repeating the steps of generating ions, mass filtering and analysing the ions multiple times takes place over an extended period of time, which in some embodiments is typically one or more days, or more preferably one or more weeks or one or more months, i.e. over a long term operation of the mass spectrometer. Preferably, the long term period is the period between consecutive cleaning operations of the quadrupole mass filter to remove the build-up of contamination. The relatively long period is long, or at least longer, for example relative to the relatively short period in which the electrodes are switched during a mass spectrometry experiment. In some embodiments, the relatively short period may be one day or less (i.e. 24 hours or less). It can be seen that over a first period each pair of opposing electrodes spends substantially half the time with the attractive DC voltage applied to it and half the time with the repulsive DC voltage applied to it, while over a second period that is shorter than the first period a quantitative accuracy of the mass analysis is maintained. Multiple second, shorter periods occur over the course of the first, longer period.

The samples may be derived from biological samples such as, for example, blood, tissue, plant extract, urine, serum, cell lysate and others. The ions may be generated from one or more samples containing one or more different molecules e.g. one or more molecules selected from: biopolymers, proteins, peptides, polypeptides, amino acids, carbohydrates, sugars, fatty acids, lipids, vitamins, hormones, polysaccharides, phosphorylated peptides, phosphorylated proteins, glycopeptides, glycoproteins, oligionucleotides, oligionucleosides, DNA, fragments of DNA, cDNA, fragments of cDNA, RNA, fragments of RNA, mRNA, fragments of mRNA, tRNA, fragments of tRNA, monoclonal antibodies, polyclonal antibodies, ribonucleases, enzymes, metabolites, and/or steroids. The sample typically comprises a plurality of different molecules (i.e. different molecular species), which give rise to a plurality of different ions in an ion source, which can be mass filtered by their mass-to-charge ratio. The sample may comprise at least 2, 5, 10, 20, 50 different molecules, or may be a complex sample comprising at least 100, 500, 1000, or 5000 different molecules.

In some preferred embodiments, the pair of opposing electrodes to which the attractive DC voltage is applied and the pair of opposing electrodes to which the repulsive DC voltage is applied are the same each time ions are selected using substantially the same selection parameters of the quadrupole mass filter and/or when the samples used to generate the ions are related in a mass spectrometry experiment. Thus, the quantitative accuracy should be maintained for analysing samples in a given experiment.

Samples may be related in an experiment by similarities in their time of analysis and/or composition. Samples may be related, for example, if they need to be quantitatively compared, e.g. comparing their mass analysis quantitatively to each other. Thus, the mass analysis is preferably quantitative mass analysis. This may be the case, if the samples are analysed within a predetermined time of each other. Examples of related samples can include: samples eluted from the same chromatographic run, samples that are ionised in the same period between consecutive mass calibrations of the mass spectrometer, samples that are replicates, samples from the same biological source, samples containing identical or near-identical sets of analytes (for example samples containing at least 90% or at least 95% of their analytes in common), and samples containing an internal standard (e.g. an added isotopically-heavy (thus higher m/z) analogue of a target molecule to be quantified, the known concentration of the internal standard being used to quantify the target molecule).

The ions can be generated from the sample by any of the following ion sources: electrospray ionisation (ESI), atmospheric pressure chemical ionisation (APCI), atmospheric pressure photoionisation (APPI), atmospheric pressure gas chromatography (APGC) with glow discharge, AP-MALDI, laser desorption (LD), inlet ionization, DESI, laser ablation electrospray ionisation (LAESI), inductively coupled plasma (ICP), laser ablation inductively coupled plasma (LA-ICP), electron impact ionisation (EI), chemical ionisation (CI) etc. Any of these ion sources can be interfaced to any of the following sample separations upstream of the ion source: liquid chromatography (LC), ion chromatography (IC), gas chromatography (GC), capillary zone electrophoresis (CZE), two dimensional GC (GC×GC), two dimensional LC (LC×LC), etc.

The RF and DC voltages may be provided to the quadrupole mass filter by respective voltage supplies that are preferably controlled by the controller. The controller may comprise a computer and electronics associated therewith for controlling the RF and DC voltages and for switching the pair of opposing electrodes of the quadrupole to which the attractive DC voltage is applied and the pair of opposing electrodes to which the repulsive DC voltage is applied. The electronics may comprise a power supply board for the quadrupole that generates RF and DC with high speed (e.g. taking a few milliseconds to change from zero to full amplitude). For switching, only the DC voltages may be flipped, which are much smaller than the RF voltages.

The controller comprising a computer and associated electronics may be programmed with a program for causing the controller to operate the mass spectrometer in accordance with the invention. The program may be provided on a computer readable medium.

The spectrometer may further comprise a data processing system for receiving data from the mass analyser or detector representative of the quantity of mass analysed or detected ions and processing the data to provide quantitative analysis of the ions. The controller may comprise the data processing device. The computer of the controller may comprise the data processing device. The data processing device may comprise a storage unit for storing data in data sets.

The controller and/or data processing device may comprise an instrument interface, which is adapted to send commands to or operate the mass spectrometer. As mentioned, the data processing system is configured to receive measured data from the mass analyser or detector, e.g. via the instrument interface. Connection between the data processing device and the spectrometer may be established by a wire or a glass fibre or wirelessly.

Preferably, the controller and/or data processing device further comprises visualization means, in particular a display and/or a printer, and interaction means, in particular a keyboard and/or a mouse, so that a user can view and enter information. When the controller and/or data processing device comprises visualization means and interaction means, operation of the spectrometer is preferably controlled via a graphical user interface (GUI). The controller and/or data processing device can be realized as a computer, which may be in a distributed form with a number of processing devices interconnected by a wired or wireless network.

DETAILED DESCRIPTION OF EMBODIMENTS

In order to enable a more detailed understanding of the invention, various embodiments will now be described with reference to the drawings. It should be understood that the scope of the invention is not limited to such embodiments, which are examples only.

Figure 1:
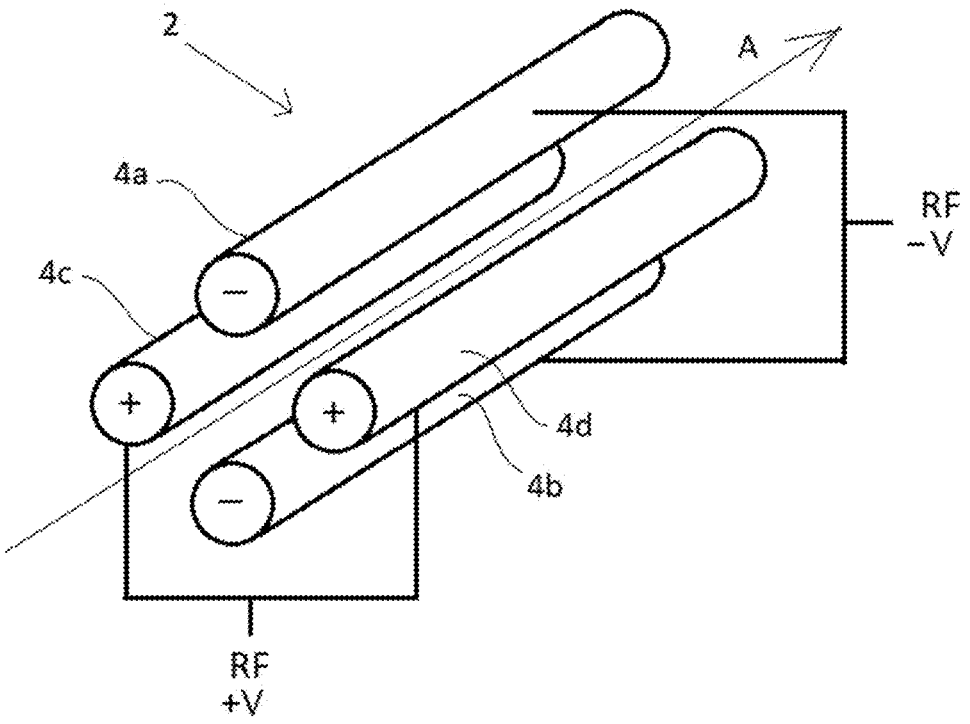
FIG. 1 shows schematically electrical and mechanical layout of a quadrupole mass filter.

Referring to FIG. 1, a quadrupole mass filter 2 shown schematically comprises four parallel elongate electrodes 4*a*-4*d*, which in the shown embodiment are rods, spaced apart in a square arrangement around a central axis. The electrode cross sectional shape is round but in other embodiments the electrode shape could be hyperbolic or rectangular (flat). Opposing electrodes are connected together electrically and a voltage is applied between one pair of rods and the other, which comprises a radio frequency (RF) voltage with a DC offset voltage. Ions travel through the quadrupole between the rod electrodes. For given values of RF and DC voltages, ions of a certain mass-to-charge ratio (m/z) will be transmitted through the quadrupole along the central axis between the rods as shown by arrow A, while other ions will have unstable trajectories and collide with the rod electrodes. An attractive DC voltage (e.g. negative voltage for positive ions) is applied to one pair of opposing rods (4*a*, 4*b*) and an equal magnitude repulsive DC voltage (e.g. positive voltage for positive ions) is applied to the other pair of opposing rods (4*c*, 4*d*). The attractive and repulsive DC voltages impose a mass cut-off to the range of ion m/z ratios that can pass through the quadrupole filter. Typically, ions with m/z ratios higher than the selected m/z ratio collide with the attractive rods, while ions with lower m/z ratios collide with the repulsive rods. With an appropriate calibration of the RF and DC voltages, the quadrupole mass filter can filter ions over a wide-range of m/z ratios and with variable mass selection window widths as known in the art.

Typically, due to quadrupole manufacturing techniques, mechanical tolerances and/or electronics limitations, the attractive and repulsive DC voltages during instrument operation are always applied to the same opposing rod pairs. This means that as ions are filtered by the device, ions with unstable trajectories (especially having a mass-to-charge ratio greater than the isolated m/z) will preferentially deposit on one pair of opposing rods compared to the other pair. Over time, especially under high ion load and challenging sample conditions, the deposition of material in this way and subsequent charging of this material will lead to disturbances in the quadrupolar field and thus the performance of the mass filter will suffer, for example in the form of transmission loss and calibration obsolescence. The quadrupole mass filter then requires mechanical cleaning to regain the lost performance. The invention addresses this problem of robustness of quadrupole mass filters. As will be described, the invention can enhance the robustness without a substantial loss in mass filtering performance, including the quantitative accuracy.

The invention is based on alternating the pair of opposing rods to which the attractive and repulsive DC voltages are applied, thereby distributing the deposited material approximately equally on all four rods over the long term use of the instruments (e.g. over a number of days, weeks or months). The process of alternating the rod pairs receiving the DC voltages is herein variously referred to as "rod switching" or "switching rods". In addition to effectively doubling the surface area for material deposition, equal deposition of material on all four rods ensures that disturbances to the quadrupolar field are matched on each rod, thus minimizing their effect. This has been found to lead to a more than 2× increase in the time between required cleaning of the rods and lower contamination-related performance loss.

Figure 2:
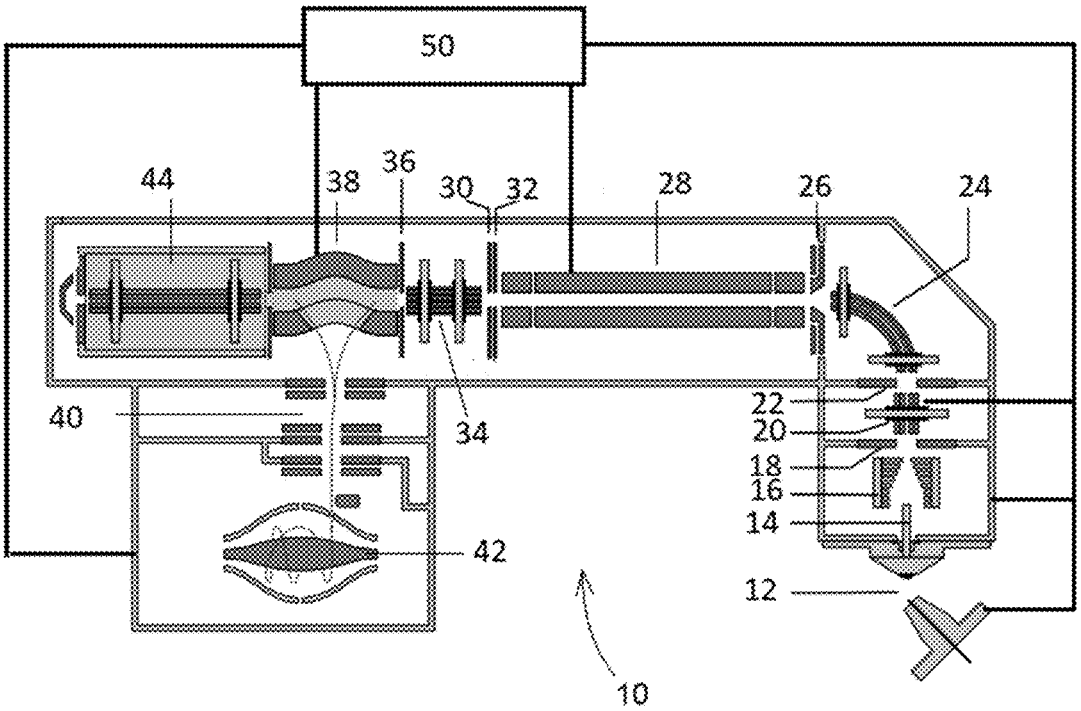
FIG. 2 shows schematically a mass spectrometer comprising a quadrupole mass filter in tandem with an orbital trap mass analyser.

An example of a mass spectrometer comprising a quadrupole mass filter is shown schematically in FIG. 2. The mass spectrometer 10 comprises an atmospheric pressure ion source 12, such as an ESI source. It will be appreciated that the ion source of the mass spectrometer can be interfaced to a separation device such as a chromatograph (not shown). Generated ions having an initially wide mass range pass through a transfer tube 14 and an RF electrodynamic ion funnel 16 in a first stage of vacuum of around 3 mbar in use. After passing through an ion funnel lens 18, the ions enter an injection flatapole 20. The injection flatapole 20 is a quadrupole comprising four elongate electrodes having rectangular cross section and flat surfaces facing the ions. An RF voltage is applied to the injection flatapole 20. In some embodiments, additional DC voltages can be applied to the opposing pairs of the electrodes of the injection flatapole 20 (voltages of equal magnitude but opposite polarity) to provide a coarse mass filtering of the ions, i.e. to filter ions outside of a narrower selected mass range transmitted by a downstream quadrupole mass filter 28. The injection flatapole 20 can therefore act as a mass pre-filter as described in more detail below. After exiting the injection flatapole, the ions pass through a lens 22, a bent flatapole ion guide 24 which can remove neutral species, and a further lens 26.

Mass filtering of the ions can then be performed in a quadrupole mass filter 28 comprising four hyperbolic shape rod electrodes. The quadrupole mass filter 28 is constructed as a segmented quadrupole comprising a main quadrupole segment and end segments at each end. The quadrupole mass filter 28 is housed in a vacuum chamber at a pressure of about $3\times10^{-5}$ mbar in use. Operating parameters of the quadrupole mass filter 28 in the form of RF and DC voltages applied to the rods are set in accordance with required mass selection parameters so as to transmit ions through the quadrupole mass filter within at least one selected range of mass-to-charge ratios that is narrower than the initial mass range of the ions from the ion source, or narrower than a pre-filtered mass range if pre-filtered by the flatapole 20. A portion of the ions outside the selected range that are not transmitted by the quadrupole mass filter 28 collide with the rods and cause a build-up of contamination on the rods, which is addressed by the invention and described further below. Ions that have been mass filtered in this way are subsequently mass analysed or detected.

The ions leaving the quadrupole mass filter 28 pass through split gate 30, 32 and a transfer multipole 34, before entering an RF curved linear ion trap 38 (C-trap) though an entrance lens 36. The split gate 30, 32 transmits ions during filling of the C-trap 38 and deflects them at other times. The ion trap 38 also has an exit lens system 40. Trapping DC voltages can be applied to the entrance and exit lenses of the ion trap 38 so as to trap and cool ions therein. Ions from one or more mass filtering steps, e.g. within one or more mass selection ranges, can be trapped together in the ion trap 38. The ions are then ejected radially from the ion trap 38 by switching off its RF and applying a DC ejection pulse to send the ions as a pulse via a Z-lens 40 into an electrostatic orbital trapping mass analyser 42 (an Orbitrap mass analyser), which is a type of Fourier transform mass analyser (FTMS analyser) and has a pressure inside of less than $10^{-9}$ mbar. It will be appreciated that in other embodiments, another type of mass analyser could be used, such as time-of-flight, FT-ICR etc. In some embodiments, the ions mass filtered by the quadrupole mass filter 28 can instead be detected by a detector positioned downstream (for example in place of the ion trap 38 and the other downstream ion optics), i.e. without further mass analysis. Such a detector can be an electron multiplier type or Faraday cup. A mass spectrum can be obtained in that case by scanning the mass selection range of the quadrupole mass filter 28 and detecting the ions at each mass in the range.

In some embodiments, the mass filtered ions can be processed by transmitting them through the ion trap 38 into a gas-filled collision cell 44 (in this embodiment a higher energy collision dissociation (HCD) cell) and setting a DC offset between the ion trap 38 and collision cell 44 to cause the ions to fragment in the collision cell 44. The fragment ions from the collision cell 44 are returned to the ion trap 38, for example by changing the DC offset of the collision cell, before ejection to the mass analyser 42. The mass analyser provides a mass spectrum of the ions analysed.

The ion source 12, RF ion funnel 16, injection flatapole 20, quadrupole mass filter 28, ion trap 38 and mass analyser 42, as well as other components of the mass spectrometer, are each under the control of a system controller 50, which is thereby able to control the generation of the ions, mass filtering and mass analysis. The system controller 50 comprises a computer, which functions as a data processor for receiving data from the mass analyser representative of the quantity of mass analysed or detected ions and processing the data to provide a mass spectrum and/or quantitative analysis of the ions. The system controller 50 further comprises a display and interaction means, in particular a keyboard and/or a mouse, so that the user can view and enter information.

The system controller 50 further comprises various voltage supplies and associated control electronics under the control of the computer, which is configured to perform the method of the invention. The system controller 50 is configured to transmit the at least one selected range of mass-to-charge ratios thorough the quadrupole mass filter 28 in accordance with set selection parameters. The system controller 50 furthermore controls the rod switching of the quadrupole mass filter 28, in order to switch the rods to which the attractive and repulsive DC voltages are applied in accordance with the invention.

As mentioned, a portion of ions outside the selected range that are not transmitted by the quadrupole mass filter 28 collide with the rods and cause a build-up of contamination on the rods. The invention addresses this by switching the pair of opposing rods to which the attractive and repulsive DC voltages are applied multiple times, thereby distributing the deposited material approximately equally on all four rods ("rod switching" or "switching rods").

One simple way to ensure equal deposition of material on all four rods, is to switch rods for each load of ions passed through the quadrupole, i.e. for each mass filtering step. For a mass spectrometer of the type shown in FIG. 2 operating at a 40 Hz mass analysis rate, for example, the quadrupole rods would likewise switch at 40 Hz. However, this strategy, while simple, has major performance drawbacks. Since each rod pair is typically somewhat mechanically different to the other, differences in ion transmission through the quadrupole between each configuration of the pairs of opposing rods to which the attractive and repulsive DC voltages are applied will manifest as oscillating signal intensity when monitoring a single ion or range of ions. For selected ion monitoring (SIM) or selected (or parallel) reaction monitoring (SRM/PRM) approaches, such signal oscillations can reduce the accuracy of quantification using peak area. Additionally, when isolating a range of ions, for instance in a data independent acquisition (DIA) scheme, the transmission differences when rod switching for ions near the extremes of the mass selection window can be greater than the transmission differences for ions near the centre of the selection window due to differences in the calibrations for each rod pair. Likewise, this reduces the quantitative accuracy when comparing the intensity of multiple ions in a single selection window.

In order to minimize these drawbacks, a preferred embodiment encodes the quadrupole mass selection parameters into a code and uses properties of the code, along with a set of rules to determine the pair of opposing rods to which the attractive DC voltage is applied and the pair of opposing electrodes to which the repulsive DC voltage is applied. In this way, the configuration of rods is switched based on the selection parameters of the quadrupole mass filter. This ensures quantitative accuracy over a wide-range of experiment types and between experiments. The system controller 50 is configured to calculate a unique code for each set of selection parameters and, based on at least one rule, use the unique code to determine the pair of opposing electrodes to which the attractive DC voltage is applied and the pair of opposing electrodes to which the repulsive DC voltage is applied A preferred method of encoding the selected range of mass-to-charge ratios comprises calculating a hash code. The hash code can be calculated via any suitable algorithm, for example CRC-32, MD5, SHA-1, or other known hash functions can be used. A preferred method of encoding the selected range of mass-to-charge ratios comprises calculating a hash code of the rounded-down centre mass of the selected range of mass-to-charge ratios. If the result of the calculation, i.e. the hashed code, is even, then one configuration of the pairs of opposing electrodes is selected; if it is odd, the other configuration of the pairs of opposing electrodes is selected.

Figure 3:
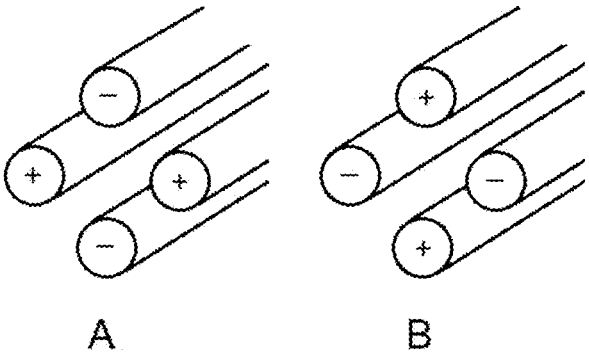
FIG. 3 shows two configurations, A and B, of the pairs of opposing electrodes to which the attractive DC voltage and the repulsive DC voltage are applied, and the usage of configurations A and B when applying the hashing algorithm based upon the rounded-down isolation centre mass and, in (a)-(e), the change in frequency of configuration switching in the isolation centre mass-domain by applying various factors from 0.25 to 4.0, whilst maintaining balanced usage of each configuration (as shown by the y-axis) label.
Figure 3:
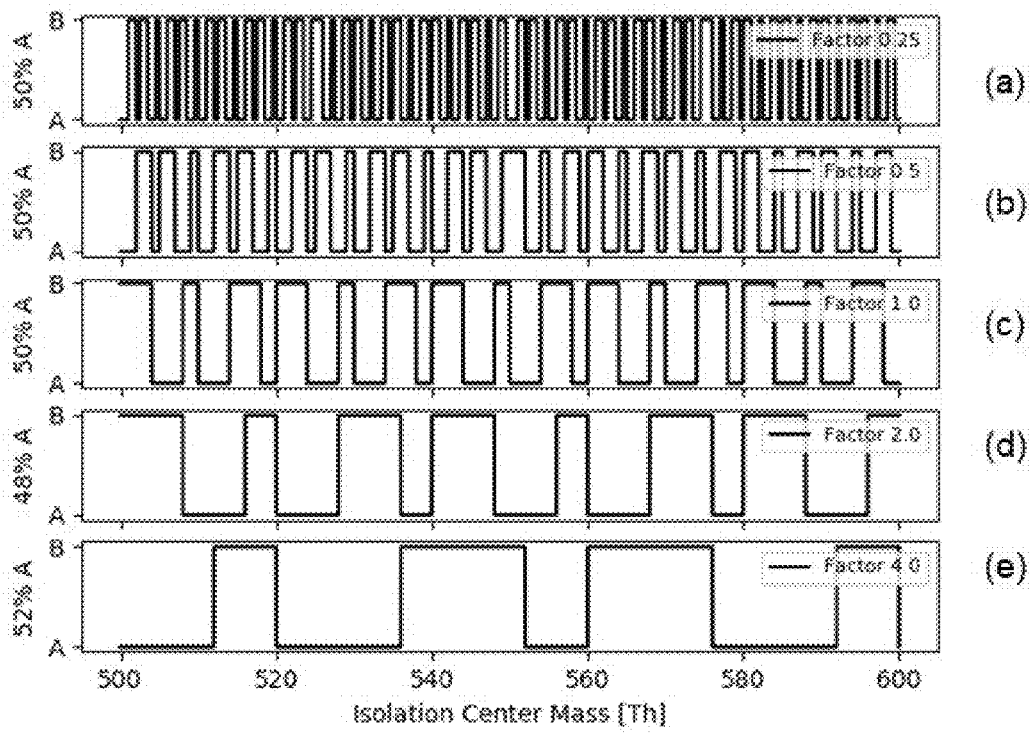

Optionally, the controller can multiply or divide the hashed value by a factor in order to increase or decrease the frequency of rod switching in the mass-to-charge ratio domain, e.g. across the centre mass-to-charge of the selected range. FIG. 3 shows how the two rod pair configurations, designated as A and B, of the pairs of opposing rods to which the attractive and repulsive DC voltages are applied change with the centre mass of the selected range for centre masses from 500-600 Th. A hash code was calculated from the rounded-down centre mass divided by factors 0.25, 0.5, 1.0, 2.0 and 4.0 (respectively plots (a), (b), (c), (d) and (e)), which modulate the switching frequency with centre mass. Next to the y-axis label is indicated the percentage of selection center masses assigned to rod pair A. It can be seen that approximately 50% of the centre masses are assigned to rod configuration A (and thus approximately 50% of the centre masses are assigned to rod configuration B). With this method, the rod assignment for a specific mass selection centre mass is independent of the selected range width used. In some embodiments, however, it may be preferred to select the abovementioned factor such that the anticipated selected mass range, usually known before data collection, is sufficiently smaller than the switching intervals in the mass-to-charge domain (the centre mass domain), for example by reference to the mean average of the switching intervals. This ensures that co-isolated ions with mass-to-charge ratios within [x−0.5w, x+0.5w] in a selection of centre mass x using a window of width w will likely be selected with the same configuration of rod pairs if selected for subsequent mass filtering steps. FIG. 3 shows the effect of the aforementioned factors on rod switching intervals for a centre mass range of m/z 500-600: for factors (a) 0.25, (b) 0.5, (c) 1.0, (d) 2.0, and (e) 4.0, the rod switching intervals are 0.5-1.0 Th, 1.0-2.0 Th, 2.0-4.0 Th, 4.0-8.0 Th, and 8.0-16.0 Th, respectively. If, on the other hand, an experiment contains only a small set of known ions falling in a small mass-to-charge range, setting a factor that minimizes the rod switching interval (i.e. maximizes the number of rod switches) may be required to maintain equal usage of the rod pairs.

Figure 4:
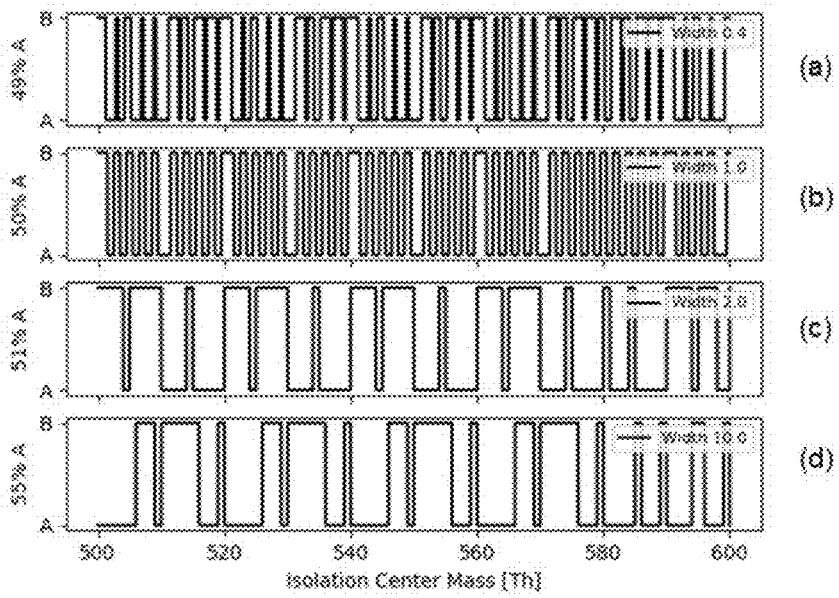
FIG. 4 shows the usage of configurations A and B of the pairs of opposing electrodes when applying the hashing algorithm based upon the rounded down first mass and rounded up last mass of an isolation window for various isolation window widths in (a)-(d).

Alternatively, the code can be calculated taking the width of the selected mass range into account. The hash code could be calculated, for example, from the result of concatenating the rounded-down first mass of the selected range to the rounded-up last mass of the range. Here, the configuration of the rod pairs assigned for a particular selected centre mass-to-charge does not necessarily stay the same if the width of the selected range changes. FIG. 4 shows how the two rod pair configurations, A and B, change with the centre mass of the selected range for centre masses from 500-600 Th when the hash code was calculated from the concatenation of the rounded-down first mass of the range and rounded-up last mass of the range at several selected range widths. The widths were 0.4 Th, 1.0 Th, 2.0 Th, and 10.0 Th (respectively plots (a), (b), (c), and (d) in FIG. 4). Next to the y-axis label is indicated the percentage of selection centre masses assigned to rod pair A. It can be seen that approximately 50% of the centre masses are assigned to rod configuration A (and thus approximately 50% of the centre masses are assigned to rod configuration B). In some preferred embodiments, the manner of creating the hash code is limited by a requirement that each time the same ionic species (in terms of mass-to-charge ratio) is analysed under conditions that are experimentally comparable, the same configuration of rod pairings of the quadrupole is selected. In this way, the quantitative accuracy of the assay is maintained within and between experiments.

Table 1 shows an example of a code-based strategy for how the rod switching can be controlled for several mass spectrometry experiment types, which are common for example in proteomics: TopN data dependent acquisition (DDA); Targeted SIM with non-overlapping windows; Targeted SRM/PRM, Data independent acquisition (DIA) with equal windows; DIA with unequal windows; and DIA with overlapping windows. The hash code was calculated based on the centre mass of the selected range with a dividing factor of 0.5, i.e. according to scheme (b) in FIG. 3. In the table, the mass range or the centre mass (CM) of the mass selection is given along with the CM/Factor, the hash code value and the quadrupole rod configuration assignment (A or B).

Figure 5:
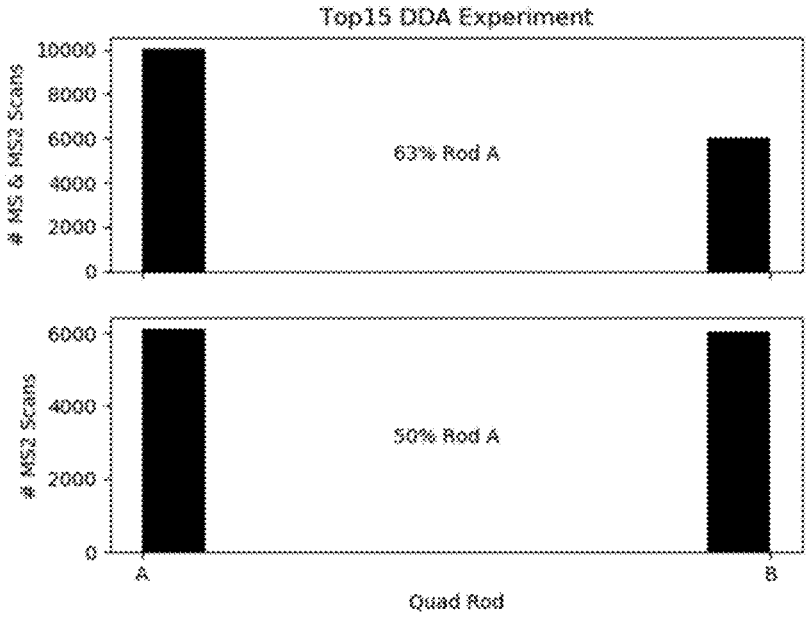
FIG. 5 shows a simulation of the usage of configurations A and B from post-acquisition analysis of data from a top15 DDA experiment, taking MS and MS2 scans into account (upper plot), and taking only MS2 scans into account (lower plot). The hash code was calculated from the rounded-down isolation center mass divided by the factor 0.5.

The same code based strategy shown in Table 1 was applied post-acquisition to data from a representative top15 DDA experiment of a typical proteomics sample with the results shown in FIG. 5. If all scans (MS and MS2) are taken into account, the quadrupole rod switching strategy results in, approximately, 63%/37% usage of the two configurations of rod pairs for mass selection. However, if the MS scans, which do not contribute significantly to rod contamination as most ions are passed through the device are not included in the usage calculation, the rod pair usage is roughly equal at 50%/50%.

TABLE 1

| Experiment | Scan Type | Q CM | Q CM/Factor | Hash Code | Quad Rod |
|---|---|---|---|---|---|
| TopN DDA | Full Scan 300-3000 | 1650 | 3300 | 476632517 | A |
| | MS2 645.365 w 1.0 | 645.365 | 1290 | 1717685296 | B |
| | MS2 355.442 w 1.0 | 355.442 | 710 | 1054940441 | A |
| | MS2 424.255 w 1.0 | 424.255 | 848 | 1175529043 | A |
| | . . . | | | | |
| | Full Scan 300-3000 | 1650 | 3300 | 476632517 | A |
| | MS2 2234.355 w 1.0 | 2234.355 | 4468 | 3698447437 | A |
| | MS2 715.162 w 1.0 | 715.162 | 1430 | 2550355976 | B |
| | MS2 1533.454 w 1.0 | 1533.454 | 3066 | 2702666031 | A |
| | . . . | | | | |
| | Full Scan 300-3000 | 1650 | 3300 | 476632517 | A |
| | MS2 644.883 w 1.0 | 644.883 | 1289 | 111560149 | A |
| | MS2 355.333 w 1.0 | 355.333 | 710 | 1054940441 | A |
| | MS2 423.415 w 1.0 | 423.415 | 846 | 2712210260 | B |
| Targeted SIM with Non-Overlapping Windows | SIM 524.265 w 5.0 | 524.265 | 1048 | 3734040097 | A |
| | SIM 195.088 w 1.2 | 195.088 | 390 | 4046536653 | A |
| | SIM 1521.998 w 3 | 1521.998 | 3043 | 3813408546 | B |
| | SIM 636.455 w 0.7 | 636.455 | 1272 | 384598162 | B |
| | . . . | | | | |
| | SIM 524.265 w 5.0 | 524.265 | 1048 | 3734040097 | A |
| | SIM 195.088 w 1.2 | 195.088 | 390 | 4046536653 | A |
| | SIM 1521.998 w 3 | 1521.998 | 3043 | 3813408546 | B |
| | SIM 636.455 w 0.7 | 636.455 | 1272 | 384598162 | B |
| | . . . | | | | |
| Targeted SRM/PRM | MS2 644.883 w 1.0 | 644.883 | 1289 | 111560149 | A |
| | MS2 355.333 w 1.0 | 355.333 | 710 | 1054940441 | A |
| | MS2 423.415 w 1.0 | 423.415 | 846 | 2712210260 | B |
| | MS2 1521.008 w 1.0 | 1521.008 | 3042 | 2488061876 | B |
| | . . . | | | | |

TABLE 1-continued

| Experiment | Scan Type | Q CM | Q CM/Factor | Hash Code | Quad Rod |
|---|---|---|---|---|---|
| | MS2 644.883 w 1.0 | 644.883 | 1289 | 111560149 | A |
| | MS2 355.333 w 1.0 | 355.333 | 710 | 1054940441 | A |
| | MS2 423.415 w 1.0 | 423.415 | 846 | 2712210260 | B |
| | MS2 1521.008 w 1.0 | 1521.008 | 3042 | 2488061876 | B |
| | . . . | | | | |
| DIA with | MS2 300-350 | 325 | 650 | 1531949610 | B |
| Equal | MS2 350-400 | 375 | 750 | 1519245341 | A |
| Windows | MS2 400-450 | 425 | 850 | 1372692256 | B |
| | MS2 450-500 | 475 | 950 | 1343485207 | A |
| | MS2 500-550 | 525 | 1050 | 3377485650 | B |
| | . . . | | | | |
| DIA with | MS2 300-310 | 305 | 610 | 1059288878 | B |
| Unequal | MS2 310-400 | 355 | 710 | 1054940441 | A |
| Windows | MS2 400-425 | 412.5 | 825 | 1861942632 | B |
| | MS2 425-575 | 500 | 1000 | 3022496535 | A |
| | MS2 575-680 | 627.5 | 1255 | 3133044659 | A |
| | MS2 680-700 | 690 | 1380 | 2126026566 | B |
| | MS2 700-1000 | 850 | 1700 | 2976429458 | B |
| | . . . | | | | |
| DIA with | MS2 295-355 | 325 | 650 | 1531949610 | B |
| Overlapping | MS2 345-405 | 375 | 750 | 1519245341 | A |
| Windows | MS2 395-455 | 425 | 850 | 1372692256 | B |
| | MS2 445-505 | 475 | 950 | 1343485207 | A |
| | MS2 495-555 | 525 | 1050 | 3377485650 | B |
| | . . . | | | | |

Alternatively to, or in addition to, the code-based switching approach, the rod pairs can be switched at specific points in time based on user interaction, i.e. a use-dependent trigger. The use-dependent or use-based trigger can comprise one or more time-dependent or event-dependent triggers. For example, the quadrupole rods may be switched every time the user runs a calibration procedure. As this is usually done on a regular basis and/or at regular intervals (daily, weekly etc.), the rod switching will likewise occur regularly at the same time. Since a user will usually analyse a set of related samples in one block of experiments without running intervening calibrations, comparisons between analyses of these samples will remain quantitatively accurate as they were all acquired using the same rod pair configuration.

A downside of an approach based on user interaction is that the period between rod switches in some cases can be long compared to the scan rate of the mass spectrometer (days or weeks between rod switching events versus, e.g., 40 Hz scan rate), and, as it is based on user interaction, there is no guarantee of achieving an exact 50/50 balance of the contamination load on the quadrupole rod pairs. Thus, such an algorithm should preferably additionally track the usage (e.g. in time spent, number of scans or load) of each rod pair configuration in order to omit switch events based on a criteria (e.g., if a calibration is started multiple times in a row, or is started within a certain number of scans of the previous calibration) and thereby improve the contamination load balance on the rod pairs. This could comprise in simple cases tracking total events (x ion injections in A configuration, x ion injections in B configuration), in time units (total ion injection time for all injections using rod pair A and B), or in charge units (e.g. by taking the Orbitrap-measured ion current for each ion injection additionally into account (giving a total charge accumulated in A and B configurations or a total charge lost to the electrodes as described above (i.e. through a comparison of the ion current when substantially all ions are transmitted through the quadrupole filter (in a prior MS1 scan in a DDA experiment for instance) and the ion current remaining after the mass filtering event)).

In some preferred embodiments, the mass spectrometer can track, e.g. as part of routine calibrations or evaluations, the rate of charge-up on each pair of opposing electrodes as a shift in the quadrupole main segment electrode DC stopping curve per unit charge impinged. This can be measured by scanning the transmission (ion current) versus ion energy through the quadrupole, typically by scanning the offset of the quadrupole main segment. Alternatively, the ion energy can be scanned by changing the voltage of upstream ion optics such as the bent flatapole 24 and all preceding optics. The ion current vs ion energy shows a characteristic S-curve with zero transmission when the ions start from a potential below that of quadrupole rods and full transmission when the energy is high. The centre of the S-curve (50% transmission) indicates the actual effective offset of the quadrupole rod. Alternatively, another approach to measure the rate of charge-up on each pair of opposing electrodes can be to set the spectrometer such that positive ions deposit only on one pair of opposing electrodes and negative ions deposit only on the other pair, intermittently measure (e.g. with positive ions) the ratio of the transmission of the quadrupole for both configurations of the pairs of opposing electrodes, and continue these steps of deposition and transmission measurement alternately over time. It is further possible to measure the rate of charge-up on each pair of opposing electrodes by measuring how much the transmission curves for each configuration of opposing electrodes have diverged from each other relative to the "clean" state. This rate of charge up correlates with the relative contamination levels of the two pairs of electrodes. The spectrometer controller can compare the two rates (the rates for each electrode pair) and feed this information into an active balancing system. In the balancing system, when an imbalance in the rod pair usage is detected by monitoring one or more of the aforementioned tracking measurements, the system actively biases the rod switching algorithm to bring the rod usage to a balanced state (equal time and/or contamination on each rod pair). This could be accomplished (depending on the application mode) by modifying the hashing algorithm, or if a time-based switching algorithm is used by using different times for each rod pair (e.g. instead of 5 s in configuration A and 5 s in configuration B, using 5 s in A and 4 s in configuration B), or if an event triggered mode is used by omitting one or more rod pair switch events.

A combination of the code-based and the use-triggered rod switching approaches can be employed and may be preferable as the code-based approach can provide for a high switching rate and good balance of rod pair usage for MS2 scans, and the use-triggered approach can balance fixed window MS scans over the long term.

Figure 6:
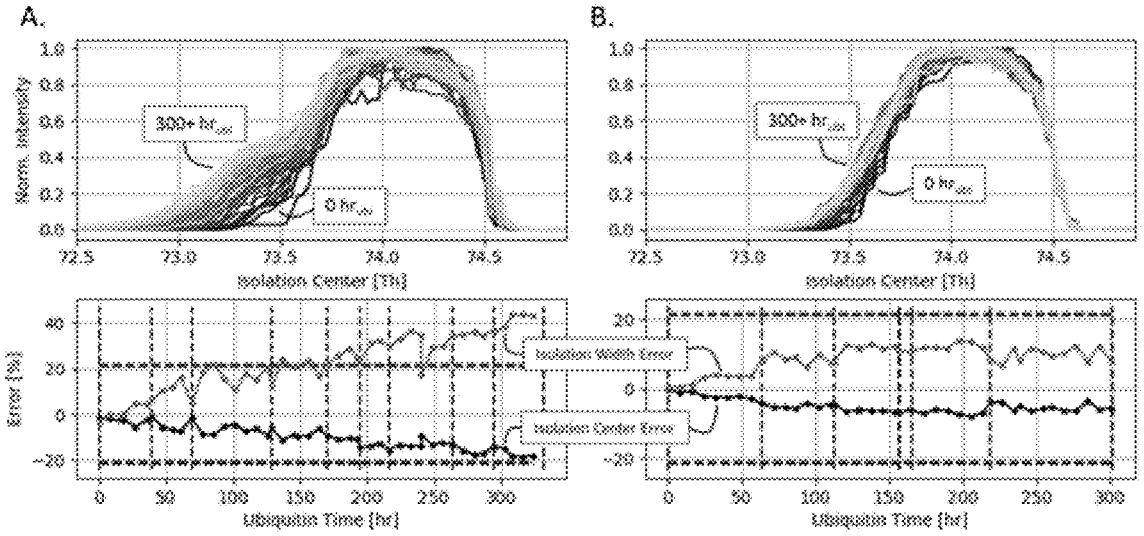
FIG. 6 shows an example of isolation profile drift (m/z 74 width 0.8) due to quadrupole contamination over more than 300 hours of analysis of a sample containing Ubiquitin with rod switching deactivated (plot A) and rod switching activated (plot B). Errors in isolation width and center mass are calculated relative to the theoretical (or set) values.

To illustrate the benefits of rod switching according to the present invention, the results of a contamination robustness experiment are shown in FIG. 6. A highly concentrated sample of Ubiquitin was continuously analysed over several weeks (more than 300 hours). Over 8 hour periods, the top ten intensity charge states of Ubiquitin were mass selected cyclically by the quadrupole mass filter of the mass spectrometer shown in FIG. 2. Following this period, the mass spectrometer performed tests to assess the contamination of the quadrupole by measuring the drift in the mass isolation profiles over time (normalised intensity against isolation mass). An example for one isolation window, m/z 74 width 0.8 Th, is shown in FIG. 6. The width of the window is measured as the width at half-maximum intensity. When rod switching was deactivated (FIG. 6A), the isolation profile width error (relative to theoretical (set) width) deviated up to 35% and the centre mass error (relative to theoretical (set) centre mass) deviated up to −20% over the 300 hours of Ubiquitin analysis. When rod switching was activated (FIG. 6 B) in accordance with the invention, both isolation width error and centre mass error deviated by less than +/−10% of the theoretical values. Some embodiments can thus provide that for the narrowest selected range of ions transmitted through the quadrupole mass filter, the width of the range at half-maximum ion transmission changes by not more than 10% when an ion transmission efficiency of the quadrupole mass filter falls by 50% or more due to the build-up of contamination on the electrodes.

In some critical user applications, the user may select the intended application, for example by a setting in the software of the system controller 50 of the mass spectrometer (e.g. "Small Molecule Quantification" setting or "Proteomics" setting etc.). The controller of the mass spectrometer then decides, based on pre-determined (accuracy/robustness) requirements of that application, whether to use rod switching and which type of rod switching algorithm or function to apply during the analyses.

The invention is preferably applied to a quadrupole mass filter having analytical resolution capability, preferably an analytical quadrupole mass filter, that is capable of, and typically used for, filtering a relatively narrow selected mass range, e.g. having a width that is 20 Th or less, 10 Th or less, 5 Th or less, 2 Th or less, or 1 Th or less, especially 2 Th or less, or 1 Th or less. The invention, however, can be implemented on such a quadrupole mass filter in combination with one or more additional quadrupole mass filters that have reduced analytical performance upstream of the analytical mass filter. Fidelity of mass isolation is determined by the number of RF cycles experienced by ions during their transit through a mass filter and is usually defined by the length of the filter. Thus, in some embodiments, for example, a first (and shortest) mass filter could isolate a mass window of more than 100 Th (e.g. 300 Th), an optional second (and longer than the first) mass filter could isolate a window of 10-50 Th (e.g. 20 Th), and a third, high resolution analytical filter could isolate a window of less than 1 Th (e.g. 0.4 Th). Assuming simplistically a uniform distribution of ions over a mass range of 1200 Th, the first filter would absorb 75% of all ions on its rods, the second filter 23.3% of all ions, and the third, analytical filter, 1.6% of all ions. As mentioned above, in the mass spectrometer shown in FIG. 2, the injection flatapole 20 could function as a first quadrupole mass filter upstream of the analytical mass filter 28. In such embodiments, the methods and means described above for rod switching with one quadrupole mass filter could likewise be applied to any number of mass filters in a series of quadrupole mass filters. The switching events could be the same for each mass filter. Ideally, one of the mass filters, for instance the final analytical filter, would determine the switching state of the rods for all of the filters in the series. In other words, a rod switch of the analytical mass filter would trigger the other mass filters to concurrently switch rods. To maintain quantitative accuracy, the rod switch states of the other filters are preferably always linked to a specific state of the analytical filter (e.g. switching between rod pair configurations B-A-B, and A-B-A, for a 3 filter series).

The symmetrical nature of contamination deposition resulting from use of the invention ensures that the gradual charging of contaminated rods also occurs symmetrically. An increasing potential barrier along the path of ion travel formed by the gradually increasing charging of the deposition material progressively hinders the ions from passing through the mass filter. Thus, it can be preferable to increase the energy of the ions as they enter the quadrupole mass filter when the ion transmission of the quadrupole mass filter falls due to a build-up of contamination on the electrodes. Ion energy can be adjusted, for example by adjusting DC offsets between ion optical devices, lenses etc. In some embodiments, therefore, over the course of repeating the steps of generating and mass filtering ions multiple times, particularly over long term operation, the energy of the ions as they enter the quadrupole mass filter is progressively increased concomitantly with the build-up of contamination on the electrodes. In embodiments, having a series of two or more quadrupole mass filters, the ion energy in each filter can be adjusted or selected according to the different rates of build-up of contamination anticipated for each filter (e.g., the ion energy could be 20 eV in the first filter, 6 eV in the second filter, and 0.5 eV in the third filter) to ensure that the potential barrier from charging starts to affect ion transmission approximately at the same time in each filter. Thereafter, all of the mass filters could be cleaned during the same cleaning session, resulting in less down-time of the instrument. Thus, the relative energy of the ions as they enter each of the quadrupole mass filters can be adjusted dependent on the length and/or the average width of the mass selection range of the mass filter.

It can be seen from the disclosure herein that the invention provides numerous advantages. The provision of rod switching can prolong the working time of a quadrupole mass filter before cleaning is needed, without significantly sacrificing quantitative and/or qualitative performance. The invention is especially beneficial for addressing contamination problems associated with proteomics experiments, i.e. analysis of multiply charged proteins and peptides, in both DDA and DIA modes. The mass filter contamination is converted from an asymmetric contamination process with respect to the pairs of opposing electrodes into a symmetric one, thus extending the robustness of the quadrupole in some cases by at least two times and increasing the time between each service of the filter (cleaning of electrodes). Embodiments of the invention ensure both contamination symmetry and maintenance of quantitative performance for many experiment types, for example using a mass selection window-dependent algorithm (such as the hashing technique to encode the mass selection parameters) and/or a user/mode-dependent trigger for selection and assignment of the repulsive and attractive DC rod pairs. The contamination effects can be further diminished by adjusting the energy of ions and/or using one or more pre-filters, with rod switching.

Herein the term mass is generally used to refer to mass-to-charge ratio (m/z), in Thomsons (Th). It will be understood that, although some embodiments will determine the mass or mass-to-charge ratio of ions, this is not essential to the successful operation of the invention. Many different physical parameters such as (but not limited to) time-of-flight, frequency, voltage, magnetic field deflection etc. might be measured (dependent for example on the chosen method of ion detection), each of which is related to or allows for the derivation of the ion mass (m/z), i.e. is representative of the mass (m/z). However it is not necessary that the mass (m/z) itself is calculated in each case; it may be computationally more efficient not to convert measured parameters in a non-mass space into mass. Furthermore the quantity stored in the comparing database may itself not be held as a mass but instead a different quantity related to mass. The term mass spectrum herein thus means a spectrum in the m/z domain or spectrum in a domain directly related to or derivable from the m/z domain, such as the frequency domain for example. The term mass also refers generally to m/z, or frequency or any other quantity directly related to m/z and vice versa (e.g. the term frequency refers also to mass etc.). The terms mass and m/z are herein used interchangeably and accordingly a reference to one includes a reference to the other.

The use of any and all examples, or exemplary language ("for instance", "such as", "for example" and like language) provided herein, is intended merely to better illustrate the invention and does not indicate a limitation on the scope of the invention unless otherwise claimed. No language in the specification should be construed as indicating any non-claimed element as essential to the practice of the invention.

As used herein, including in the claims, unless the context indicates otherwise, singular forms of the terms herein are to be construed as including the plural form and vice versa. For instance, unless the context indicates otherwise, a singular reference herein including in the claims, such as "a" or "an" means "one or more".

Throughout the description and claims of this specification, the words "comprise", "including", "having" and "contain" and variations of the words, for example "comprising" and "comprises" etc, mean "including but not limited to", and are not intended to (and do not) exclude other components.

The present invention also covers the exact terms, features, values and ranges etc. in case these terms, features, values and ranges etc. are used in conjunction with terms such as about, around, generally, substantially, essentially, at least etc. (e.g., "about 3" shall also cover exactly 3, or "substantially constant" shall also cover exactly constant).

The term "at least one" should be understood as meaning "one or more", and therefore includes both embodiments that include one or multiple components. Furthermore, dependent claims that refer to independent claims that describe features with "at least one" have the same meaning, both when the feature is referred to as "the" and "the at least one".

Any steps described in this specification may be performed in any order or simultaneously unless stated or the context requires otherwise.

All of the features disclosed in this specification may be combined in any combination, except combinations where at least some of such features and/or steps are mutually exclusive. In particular, the preferred features of the invention are applicable to all aspects of the invention and may be used in any combination. Likewise, features described in non-essential combinations may be used separately (not in combination).

It will be appreciated that variations to the foregoing embodiments of the invention can be made while still falling within the scope of the invention. Each feature disclosed in this specification, unless stated otherwise, may be replaced by alternative features serving the same, equivalent or similar purpose. Thus, unless stated otherwise, each feature disclosed is one example only of a generic series of equivalent or similar features.

The invention claimed is:

1. A method of operating a mass spectrometer, comprising:

generating ions from a sample having an initial range of mass-to-charge ratios;

mass filtering the ions using a quadrupole mass filter having a set of selection parameters to transmit ions through the quadrupole mass filter within at least one selected range of mass-to-charge ratios that is narrower than the initial range, while ions outside the selected range are not transmitted, wherein the quadrupole mass filter comprises four parallel elongate electrodes arranged in opposing pairs to which are applied RF and DC voltages, wherein an attractive DC voltage that is attractive to the ions is applied to one pair of opposing electrodes and a repulsive DC voltage that is repulsive to the ions is applied to the other pair of opposing electrodes;

mass analysing or detecting the ions transmitted by the quadrupole mass filter;

repeating the steps of generating ions, mass filtering and mass analysing or detecting multiple times;

switching a configuration of the pairs of opposing electrodes to which the attractive DC voltage and the repulsive DC voltage are applied multiple times over the course of repeating the steps so that over long term operation a build-up of contamination on each pair of opposing electrodes is substantially equal; and determining mass filtering steps for which quantitative accuracy should be maintained between them and for the determined mass filtering steps maintaining the same configuration of the pairs of opposing electrodes to which the attractive DC voltage and the repulsive DC voltage are applied.

2. A method according to claim 1, wherein over long term operation each pair of opposing electrodes spends substantially half the time with the attractive DC voltage applied to it and half the time with the repulsive DC voltage applied to it.

3. A method according to claim 1, wherein the configuration is switched based on the selection parameters of the quadrupole mass filter and/or a use-based trigger.

4. A method according to claim 1, wherein the steps of generating ions and mass filtering the ions are repeated multiple times using different sets of selection parameters of the quadrupole mass filter.

5. A method according to claim 1, wherein the configuration of the pair of opposing electrodes to which the attractive DC voltage is applied and the pair of opposing electrodes to which the repulsive DC voltage is applied are the same each time ions are selected using substantially the same selection parameters of the quadrupole mass filter and/or when samples used to generate the ions are related by similarities in their time of analysis or composition.

6. A method according to claim 1, further comprising calculating a unique code for each set of selection parameters and, based on at least one rule, using the unique code to determine the pair of opposing electrodes to which the attractive DC voltage is applied and the pair of opposing electrodes to which the repulsive DC voltage is applied.

7. A method according to claim 6, wherein the unique code is calculated based on one or both of: (i) a centre mass and/or based on a first mass and a last mass of the selected range of mass-to-charge ratios, or (ii) a rounded down centre mass and/or based on a rounded down first mass and a rounded up last mass of the selected range of mass-to-charge ratios.

8. A method according to claim 6, wherein the at least one rule comprises applying the attractive DC voltage to a first pair of opposing electrodes and the repulsive DC voltage to a second pair of opposing electrodes if the unique code is an even value and applying the attractive DC voltage to the second pair of opposing electrodes and the repulsive DC voltage to the first pair of opposing electrodes if the unique code is an odd value.

9. A method according to claim 6, wherein the unique code is multiplied or divided by a factor to increase or decrease the frequency in the mass-to-charge ratio domain of switching the pairs of opposing electrodes to which the attractive DC and repulsive DC voltages are applied.

10. A method according to claim 9, wherein the factor is such that the selected range of mass-to-charge ratios is sufficiently narrower than the average interval in the mass-to-charge ratio domain between switching the pairs of opposing electrodes such that transmitted ions in a range of mass-to-charge ratios, $x-0.5w$ to $x+0.5w$, where x is the centre mass and w is the width of the selected range, will most likely be selected using the same pairs of opposing electrodes to which the attractive DC and repulsive DC voltages are applied if they are selected in a subsequent mass filtering step.

11. A method according to claim 1, wherein the pair of opposing electrodes to which the attractive DC voltage is applied and the pair of opposing electrodes to which the repulsive DC voltage is applied are switched based on one or more use-dependent triggers.

12. A method according to claim 11, wherein the one or more use-dependent triggers comprises one or more time-dependent or event-dependent triggers.

13. A method according to claim 12, wherein the one or more time-dependent or event-dependent triggers comprises running a mass calibration procedure or elapse of a predetermined time period since the pair of opposing electrodes were last switched.

14. A method according to claim 1, further comprising collecting and storing usage data representing the usage of each pair of opposing electrodes when each of the attractive DC voltage and the repulsive DC voltage is applied and, based on the usage data, switching the pair of opposing electrodes to which the attractive DC voltage is applied and the pair of opposing electrodes to which the repulsive DC voltage is applied such that on average each pair of opposing electrodes spends substantially half the time with the attractive DC voltage applied to it and half the time with the repulsive DC voltage applied to it.

15. A method according to claim 1, further comprising acquiring data representing the amount of contamination on each pair of opposing electrodes and, based on the data, switching the pair of opposing electrodes to which the attractive DC voltage is applied and the pair of opposing electrodes to which the repulsive DC voltage is applied so as to balance the amount of contamination equally between each pair of opposing electrodes.

16. A method according to claim 1, further comprising pre-filtering the ions before mass filtering the ions using the quadrupole mass filter, wherein pre-filtering the ions comprises transmitting to the quadrupole mass filter ions within a pre-selected range of mass-to-charge ratios that includes but is wider than the selected range of mass-to-charge ratios selected by the quadrupole mass filter.

17. A method according to claim 1, further comprising increasing the energy of the ions as they enter the quadrupole mass filter when the ion transmission of the quadrupole mass filter falls due to the build-up of contamination on the electrodes.

18. A mass spectrometer, comprising:

an ion source for generating ions from a sample having an initial range of mass-to-charge ratios;

a quadrupole mass filter having a set of selection parameters for mass filtering the ions so as to transmit ions through the quadrupole mass filter within at least one selected range of mass-to-charge ratios that is narrower than the initial range, while ions outside the selected range are not transmitted, wherein the quadrupole mass filter comprises four parallel elongate electrodes arranged in opposing pairs to which are applied RF and DC voltages, wherein an attractive DC voltage that is attractive to the ions is applied to one pair of opposing electrodes and a repulsive DC voltage that is repulsive to the ions is applied to the other pair of opposing electrodes;

a mass analyser or detector to analyse or detect ions transmitted through the quadrupole mass filter; and a controller configured to control the quadrupole mass filter and switch a configuration of the pairs of opposing electrodes to which the attractive DC voltage and the repulsive DC voltage are applied multiple times over the course of repeating steps of generating ions and mass filtering the ions so that over long term operation of the mass spectrometer a build-up of contamination on each pair of opposing electrodes is substantially equal, the controller being further configured to determine mass filtering steps between which quantitative accuracy should be maintained and for the determined mass filtering steps maintain the same configuration of the pairs of opposing electrodes to which the attractive DC voltage and the repulsive DC voltage are applied.

19. A mass spectrometer according to claim 18, wherein the controller is configured to switch the configuration of the pairs of opposing electrodes to which the attractive DC voltage and the repulsive DC voltage are applied so that over long term operation of the mass spectrometer each pair of opposing electrodes spends substantially half the time with the attractive DC voltage applied to it and half the time with the repulsive DC voltage applied to it.

20. A mass spectrometer according to claim 18, wherein the controller is configured to switch the configuration based on the selection parameters of the quadrupole mass filter and/or a use-based trigger.

21. A mass spectrometer according to claim 18, wherein the selected range of mass-to-charge ratios has a width 10 Th or less.

22. A mass spectrometer according to claim 18, wherein the controller is configured such that the pair of opposing electrodes to which the attractive DC voltage is applied and the pair of opposing electrodes to which the repulsive DC voltage is applied are the same each time ions are selected using substantially the same selection parameters of the quadrupole mass filter and/or when the samples used to generate the ions are related.

23. A mass spectrometer according to claim 18, wherein the controller is configured to set selection parameters of the quadrupole mass filter to transmit the at least one selected range of mass-to-charge ratios and to calculate a unique code for each set of selection parameters and, based on at least one rule, use the unique code to determine the pair of opposing electrodes to which the attractive DC voltage is applied and the pair of opposing electrodes to which the repulsive DC voltage is applied.

24. A mass spectrometer according to claim 23, wherein the unique code is a code calculated using a hash function.

25. A mass spectrometer according to claim 23, wherein the unique code is calculated based on a centre mass and/or based on a first mass and a last mass of the selected range of mass-to-charge ratios.

26. A mass spectrometer according to claim 23, wherein the unique code is calculated based on a rounded down centre mass and/or based on a rounded down first mass and a rounded up last mass of the selected range of mass-to-charge ratios.

27. A mass spectrometer according to claim 23, wherein the at least one rule comprises applying the attractive DC voltage to a first pair of opposing electrodes and the repulsive DC voltage to a second pair of opposing electrodes if the unique code is an even value and applying the attractive DC voltage to the second pair of opposing electrodes and the repulsive DC voltage to the first pair of opposing electrodes if the unique code is an odd value.

28. A mass spectrometer according to claim 23, wherein the unique code is multiplied or divided by a factor to increase or decrease the frequency in the mass-to-charge ratio domain of switching the pairs of opposing electrodes to which the attractive DC and repulsive DC voltages are applied.

29. A mass spectrometer according to claim 28, wherein the factor is such that the selected range of mass-to-charge ratios is sufficiently narrower than the average interval in the mass-to-charge ratio domain between switching the pairs of opposing electrodes such that transmitted ions in a range of mass-to-charge ratios $x-0.5w$ to $x+0.5w$, where $x$ is the centre mass of the selected range and $w$ is the width of the selected range, will most likely be selected using the same pairs of opposing electrodes to which the attractive DC and repulsive DC voltages are applied if they are selected in a subsequent mass filtering step.

30. A mass spectrometer according to claim 18, wherein the pair of opposing electrodes to which the attractive DC voltage is applied and the pair of opposing electrodes to which the repulsive DC voltage is applied are switched based on one or more use-dependent triggers.

31. A mass spectrometer according to claim 30, wherein the one or more use-dependent triggers comprises one or more time-dependent or event-dependent triggers.

32. A mass spectrometer according to claim 31, wherein the one or more time-dependent or event-dependent triggers comprises running a mass calibration procedure or elapse of a predetermined time period since the pair of opposing electrodes were last switched.

33. A mass spectrometer according to claim 18, wherein the controller is configured to collect and store usage data representing the usage of each pair of opposing electrodes when each of the attractive DC voltage and the repulsive DC voltage is applied and, based on the usage data, switch the pair of opposing electrodes to which the attractive DC voltage is applied and the pair of opposing electrodes to which the repulsive DC voltage is applied such that on average each pair of opposing electrodes spends substantially half the time with the attractive DC voltage applied to it and half the time with the repulsive DC voltage applied to it.

34. A mass spectrometer according to claim 18, wherein the controller is configured to switch the pair of opposing electrodes to which the attractive DC voltage is applied and the pair of opposing electrodes to which the repulsive DC voltage is applied based on data representing an amount of contamination on each pair of opposing electrodes.

35. A mass spectrometer according to claim 18, further comprising one or more mass pre-filters, located upstream of the quadrupole mass filter, for filtering the ions before the quadrupole mass filter, wherein the one or more mass pre-filters are controlled to transmit to the quadrupole mass filter ions within a pre-selected range of mass-to-charge ratios that includes but is wider than the selected range of mass-to-charge ratios selected by the quadrupole mass filter.

36. A mass spectrometer according to claim 35, wherein the pre-selected range has a width greater than 10 Th, or greater than 50 Th, or greater than 100 Th.

37. A mass spectrometer according to claim 35, wherein the one or more mass pre-filters comprise one or more quadrupole mass pre-filters, wherein a pair of opposing electrodes of the one or more quadrupole mass pre-filters to which an attractive DC voltage is applied and a pair of opposing electrodes to which a repulsive DC voltage is applied are switched at the same times as switching the configuration of the quadrupole mass filter.

38. A mass spectrometer according to claim 35, wherein the controller is further configured to increase the energy of the ions as they enter the quadrupole mass filter when the ion transmission of the quadrupole mass filter falls due to a build-up of contamination on the electrodes.

39. A mass spectrometer, comprising:

an ion source for generating ions from a sample having an initial range of mass-to-charge ratios;

a quadrupole mass filter having a set of selection parameters for mass filtering the ions so as to transmit ions through the quadrupole mass filter within at least one selected range of mass-to-charge ratios that is narrower than the initial range, while ions outside the selected range are not transmitted, wherein the quadrupole mass filter comprises four parallel elongate electrodes arranged in opposing pairs to which are applied RF and DC voltages, wherein an attractive DC voltage that is attractive to the ions is applied to one pair of opposing electrodes and a repulsive DC voltage that is repulsive to the ions is applied to the other pair of opposing electrodes, wherein a portion of the ions outside the selected range that are not transmitted collide with the electrodes and cause a build-up of contamination on the electrodes;

a mass analyser or detector to analyse or detect ions transmitted through the quadrupole mass filter; and a controller configured to control the quadrupole mass filter and switch a configuration of the pairs of opposing electrodes to which the attractive DC voltage and the repulsive DC voltage are applied multiple times over the course of repeating steps of generating ions and mass filtering the ions, such that over long term operation of the mass spectrometer the build-up of contamination on each pair of opposing electrodes is substantially equal, whereby for a narrowest selected range of ions transmitted through the quadrupole mass filter, the width of the range at half-maximum ion transmission changes by not more than 10% when an ion transmission efficiency of the quadrupole mass filter falls by 50% or more due to the build-up of contamination on the electrodes.

* * * * *